US006545575B1

(12) United States Patent
Hirabayashi et al.

(10) Patent No.: US 6,545,575 B1
(45) Date of Patent: Apr. 8, 2003

(54) RELAY AND METHOD OF MANUFACTURE THEREOF

(75) Inventors: Michio Hirabayashi, Osaka (JP); Syuuichi Taga, Osaka (JP); Yoshiaki Tsurui, Osaka (JP); Katsuhiro Ikeda, Osaka (JP); Tsutomu Takada, Osaka (JP); Shigeru Tsujimura, Osaka (JP); Masaaki Yamazaki, Osaka (JP); Hirokazu Mukai, Osaka (JP)

(73) Assignee: Idec Izumi Corporation, Osaka (JP)

( * ) Notice: Subject to any disclaimer, the term of this patent is extended or adjusted under 35 U.S.C. 154(b) by 42 days.

(21) Appl. No.: 09/856,797

(22) PCT Filed: Sep. 27, 2000

(86) PCT No.: PCT/JP00/06682

§ 371 (c)(1),
(2), (4) Date: Sep. 4, 2001

(87) PCT Pub. No.: WO01/24212

PCT Pub. Date: Apr. 5, 2001

(30) Foreign Application Priority Data

Sep. 28, 1998 (JP) ..... 11-273938

(51) Int. Cl.[7] ..... H01H 51/08; H01H 51/22

(52) U.S. Cl. ..... 335/78; 335/80; 335/85; 335/128; 335/276

(58) Field of Search ..... 335/78–85, 106, 335/127–132, 270–276

(56) References Cited

U.S. PATENT DOCUMENTS

| | | | | |
|---|---|---|---|---|
| 1,370,914 A | | 3/1921 | Rippl | |
| 3,544,936 A | | 12/1970 | De Forest et al. | |
| 4,949,058 A | * | 8/1990 | Nishikawa et al. | 335/128 |
| 4,951,017 A | | 8/1990 | Buchschmid et al. | 335/128 |
| 5,289,144 A | | 2/1994 | Liao | 335/78 |

FOREIGN PATENT DOCUMENTS

| | | |
|---|---|---|
| EP | 0 375 398 | 6/1990 |
| JP | 89134/1976 | 7/1976 |
| JP | 55-11059 | 3/1980 |
| JP | 56-25732 | 6/1981 |
| JP | 58-13011 | 3/1983 |
| JP | 2-262219 | 10/1990 |
| JP | 59446/1984 | 4/1994 |
| JP | 2549409 | 8/1996 |
| JP | 10-321110 | 12/1998 |
| JP | 11-96875 | 4/1999 |

* cited by examiner

*Primary Examiner*—Ramon M. Barrera
(74) *Attorney, Agent, or Firm*—McDermott, Will & Emery

(57) ABSTRACT

In a relay (100), right and left sides of an edge on an upper end side of an L-shaped armature (201) are bent to form an engagement portion (201*a*) and the armature 201 is held to be rocked and displaced through an energizing spring piece (205*c*) of a hinge spring (205) in a state in which the engagement portion (201*a*) is engaged with an edge portion 204*c* of an end face 204*a* on an upper end side of a core (204). During magnetic adsorption, moreover, an upper end of the armature (201) has an outer peripheral surface thereof to abut on the end face (204*a*) at the upper end side of the core (201) in a close contact state.

11 Claims, 28 Drawing Sheets

RELAY AND METHOD OF MANUFACTURE THEREOF

TECHNICAL FIELD

The present invention relates to a relay and a relay manufacturing method.

BACKGROUND ART

In an electromagnetic portion of a relay, a magnetic circuit is constituted by a core and an armature, and the armature is rocked and displaced according to an excitation of a coil provided in an outer peripheral portion of the core. In such an electromagnetic portion, how to stabilize the rock and displacement of the armature is a subject. Moreover, how to prevent a magnetic flux from leaking from a magnetic circuit constituted by the core and the armature is also a great subject. Furthermore, a simplification of a process of manufacturing a relay and a reduction in a cost are great subjects.

DISCLOSURE OF THE INVENTION

It is a first object of the present invention to provide a relay capable of stably rocking and displacing an armature with high precision and of decreasing a leakage flux to enhance an efficiency.

Moreover, it is a second object of the present invention to provide a relay and a method of manufacturing the relay in which a manufacturing process can be simplified and a cost can be reduced.

In order to achieve the above-mentioned objects, the present invention provides a relay (100) for opening or closing a contact by an electromagnetic interaction, comprising a coil (202) having a core (204) bent like an almost L shape, an armature (201) provided to generate a predetermined axial rock and displacement by the electromagnetic interaction with the coil (202) and serving to transmit the rock and displacement to a contact portion (10) through a card (104), thereby opening or closing a contact (103*a*), an engagement portion (201*a*) provided on the armature (201), and energizing means (205*c*), wherein the armature is bent like an almost L shape such that outer peripheral surfaces of both ends thereof can abut on both end faces of the core, the engagement portion (201*a*) is provided by bending at least a part of an edge on one of sides of the armature (201) to be engaged with an edge portion (204*c*) on an end face at one of sides of the core (204), and the energizing means (205*c*) energizes the engagement portion (201*a*) of the armature (201) toward the edge portion (204*c*) of the core (204), thereby holding the armature (201) to be rocked and displaced by setting an engagement part of the engagement portion (201*a*) with the edge portion (204*c*) to be an axis.

Consequently, at least a part of the edge on one of the sides of the almost L-shaped armature is bent to form the engagement portion and the armature is held to be rocked and displaced through the energizing means in a slate in which the engagement portion is engaged with the edge portion of the end face on one of the sides of the core. Therefore, a rocked shaft is not shifted and it is possible to stably rock and displace the armature with high precision by using, as a hinge portion, the engagement part of the engagement portion of the armature and the edge portion of the core.

With such a structure, moreover, when the lower end is magnetically adsorbed, the end on one of the sides of the armature has the outer peripheral surface thereof to abut on the end face at one of the sides of the core in a close contact state. Consequently, it is possible to decrease a leakage flux from the end face on one of the sides of the core, thereby enhancing an efficiency.

Furthermore, the present invention provides a method of manufacturing the relay (100), wherein a step shape for partially selecting an end on the other side of the armature (201) and an end face on the other side of the core (204) and for causing them to abut thereon is provided on an abutment face of the armature (201), and a relief concave portion (201*e*) constituting the step shape is formed by press molding.

Consequently, the step shape for partially selecting the end on the other side of the armature and the end face on the other side of the core and for causing them to abut thereon is provided on the abutment face of the armature. Therefore, the press molding which is simple and has high processing precision can be employed for a method of forming the relief concave portion constituting the step shape. As a result, the relief concave portion can easily be formed to have a predetermined depth with high precision, and a process of manufacturing the relay can be simplified and a cost can be reduced.

BEST MODE FOR CARRYING OUT THE INVENTION

<Description of Summary>

Figure 2:
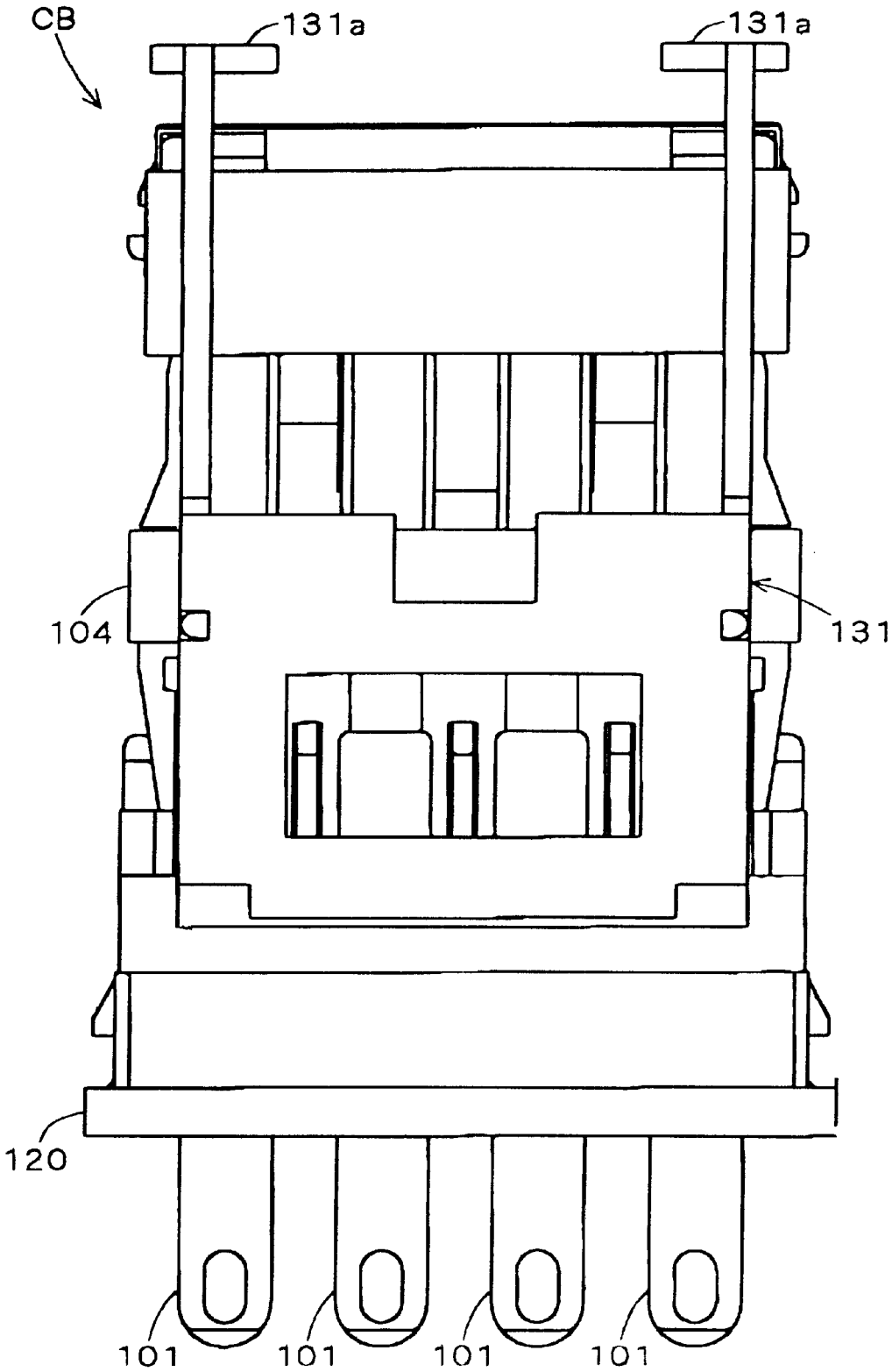
FIG. 2 is a front view showing a coupled body.
Figure 3:
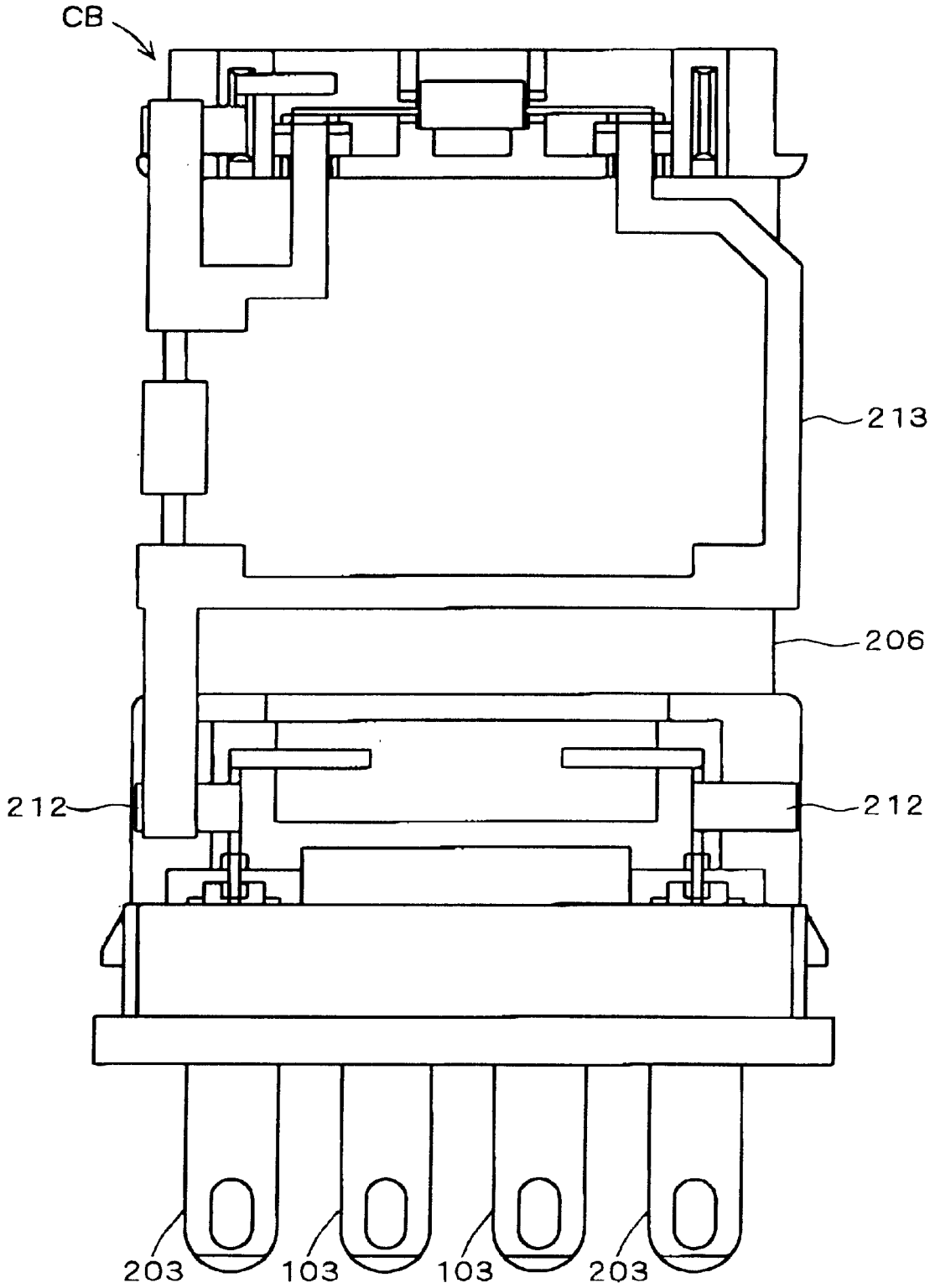
FIG. 3 is a rear view showing the coupled body.
Figure 4:
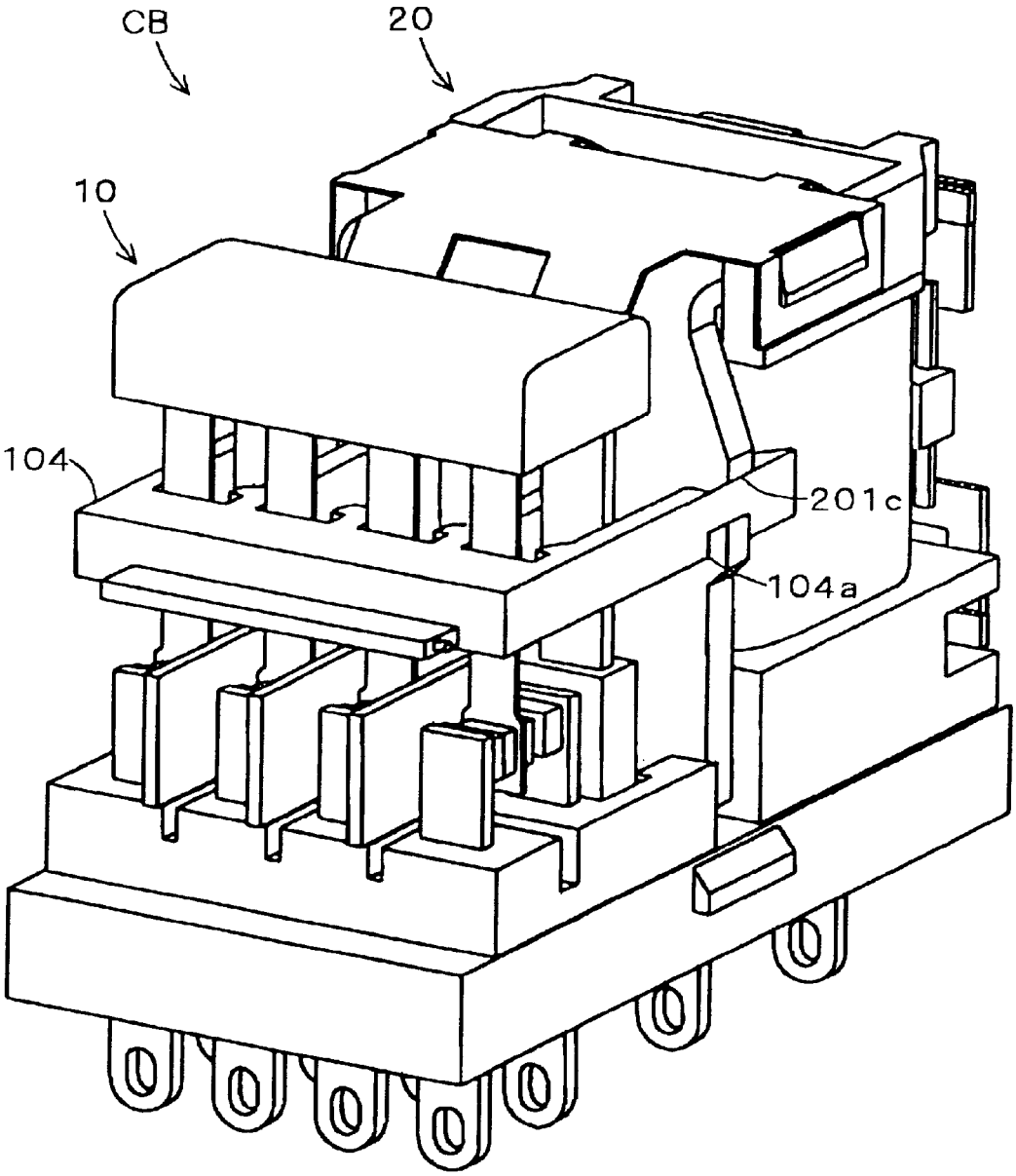
FIG. 4 is a perspective view showing the coupled body.

First of all, a relay 100 according to an embodiment of the present invention will be summarized with reference to FIGS. 1 to 5. In FIG. 4, a display lever 131 which will be described below is not shown for convenience.

Figure 1:
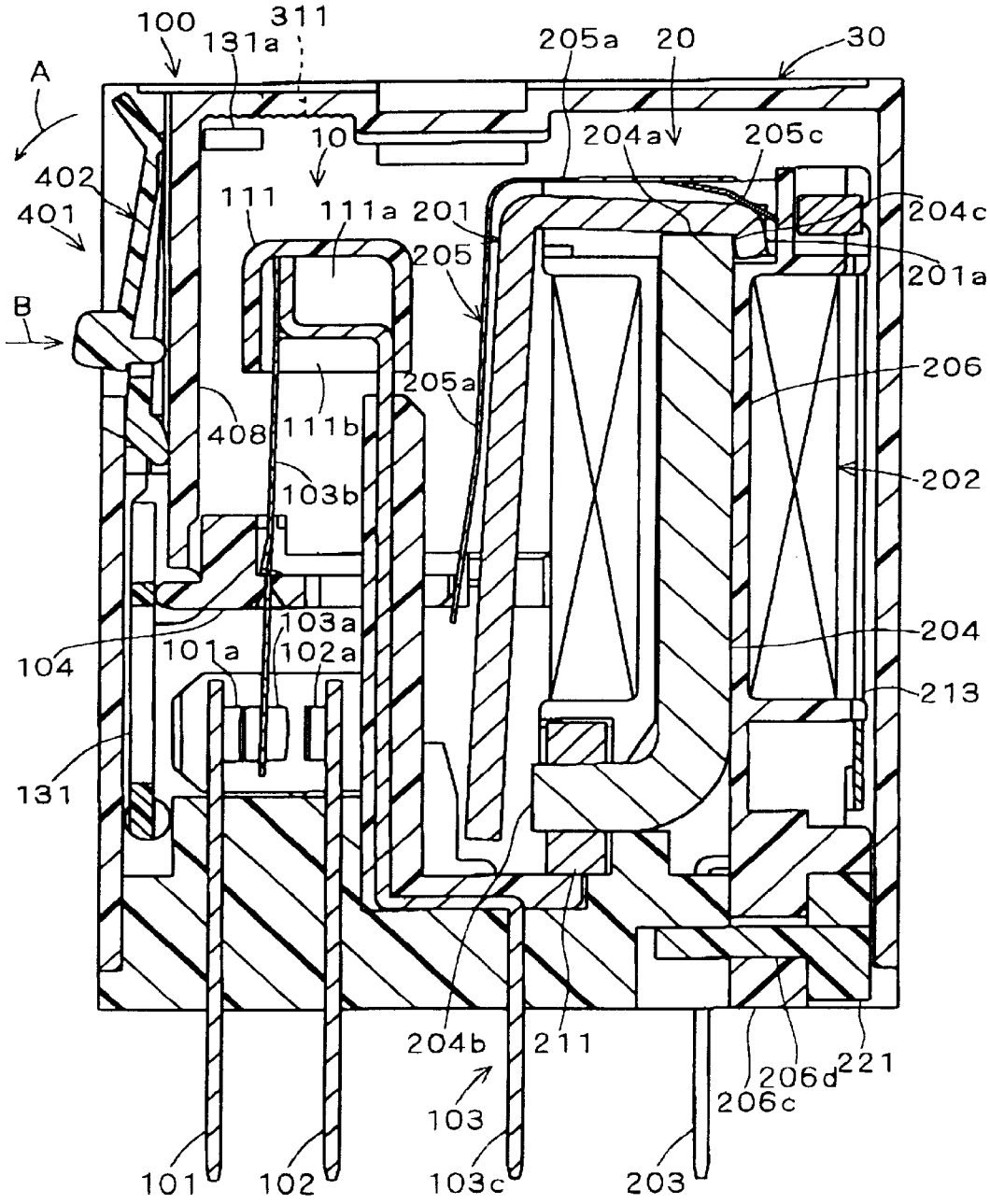
FIG. 1 is a sectional view showing a relay according to an embodiment of the present invention.

As shown in FIG. 1, the relay 100 mainly comprises a contact unit 10, a coil unit 20 and a case 30, and has such a structure that a common contact 103*a* is positioned between a normally-closed contact 101*a* and a normally-opened contact 102*a*. A voltage is applied to a coil 202 to excite and move an armature 201, and a movable spring 103*b* of a common terminal portion 103 is moved through a card 104 by the driving force so that the common contact 103*a* is moved from the normally-closed contact 101*a* side toward the normally-opened contact 102*a* side and contact switching is thus carried out. The contact unit 10 and the coil unit 20 are formed separately and are coupled like a butt, thereby constituting a coupled body CB shown in FIGS. 2 to 4.

The card 104 and the armature 201 are energized by a hinge spring 205 (spring member) toward the left side of FIG. 1 (in such a direction that the common contact 103*a* abuts on the normally-closed contact 101*a*). Then, the coil 202 is excited so that a lower end of the armature 201 is sucked into a core 204. Consequently, the card 104 and the armature 201 are moved from a state shown in FIG. 1 toward the right side of FIG. 1 (in such a direction that the common contact 103*a* abuts on the normally-opened contact 102*a*) against the energizing force of the hinge spring 205.

The contact switching operation of the relay 100 will be described below in more detail. In a state in which a voltage is not applied to the coil 202 through a coil terminal 203, the common contact 103*a* comes in contact with the normally-closed contact 101*a* and does not come in contact with the normally-opened contact 102*a* as shown in FIG. 1. At this time, the common terminal portion 103 is conducted to a normally-closed contact terminal 101. On the contrary, the common terminal portion 103 and a normally-opened contact terminal 102 are set in a disconnection state.

To the contrary, when a voltage is applied to the coil 202, the armature 201 is pulled closer to the lower end of the core 204 by a magnetic field generated from the core 204 to the armature 201, and the movement of the armature 201 is transmitted to the movable spring 103*b* through the card 104 so that the common contact 103*a* is pulled closer to the normally-opened contact 102*a* side. Consequently, the common terminal portion 103 is conducted to the normally-opened contact terminal 102. To the contrary, the common contact 103*a* is separated from the normally-closed contact 101*a* so that the common terminal portion 103 and the normally-closed contact terminal 101 are disconnected from each other.

<Holding Structure of Armature>

In the coil unit 20 according to the present embodiment, the core 204 of the coil 202 is bent like an L shape as shown in FIGS. 7 to 11. The armature 201 is bent like an L shape such that outer peripheral surfaces on both ends can abut on both end faces 204*a* and 204*b* of the core. A rectangular ring magnetic circuit is constituted by the core 204 and the armature 201.

Figure 10:
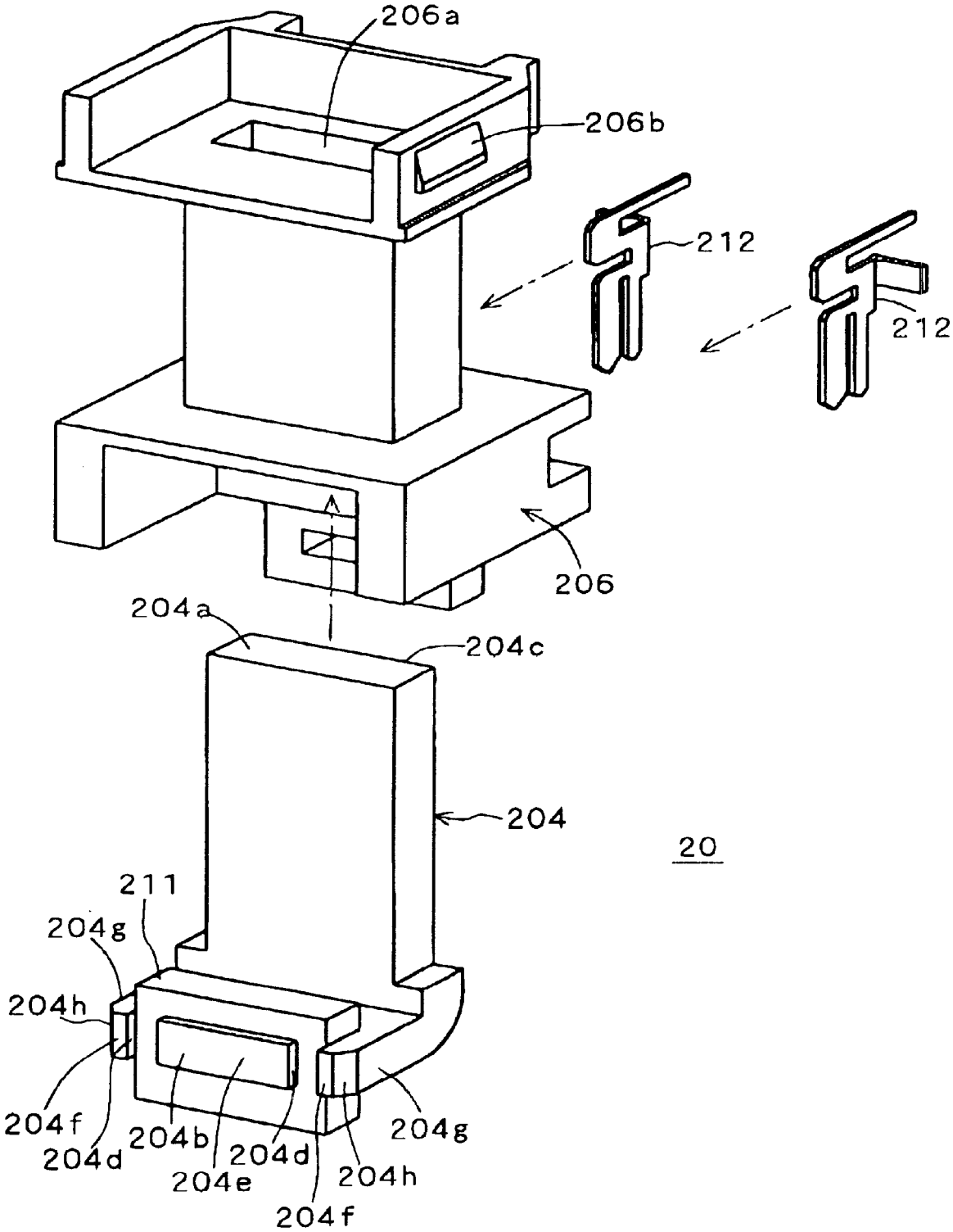
FIG. 10 is an exploded perspective view showing the coil unit.
Figure 11:
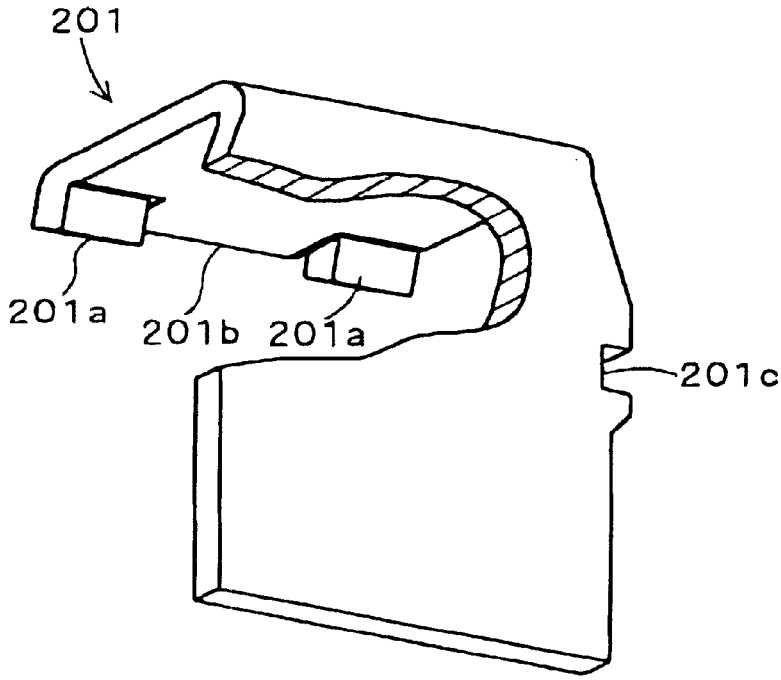
FIG. 11 is a perspective view showing an armature, a part of which is taken away.

Correspondingly, a bobbin 206 onto which the coil 202 is wound is integrally formed of a resin to have a cylindrical shape, and the core 204 is inserted from below into a through hole 206*a* in a central part as shown in FIG. 10. In such an attachment state, an upper end of the core 204 is protruded from an upper end of the bobbin 206 by a predetermined height.

Figure 7:
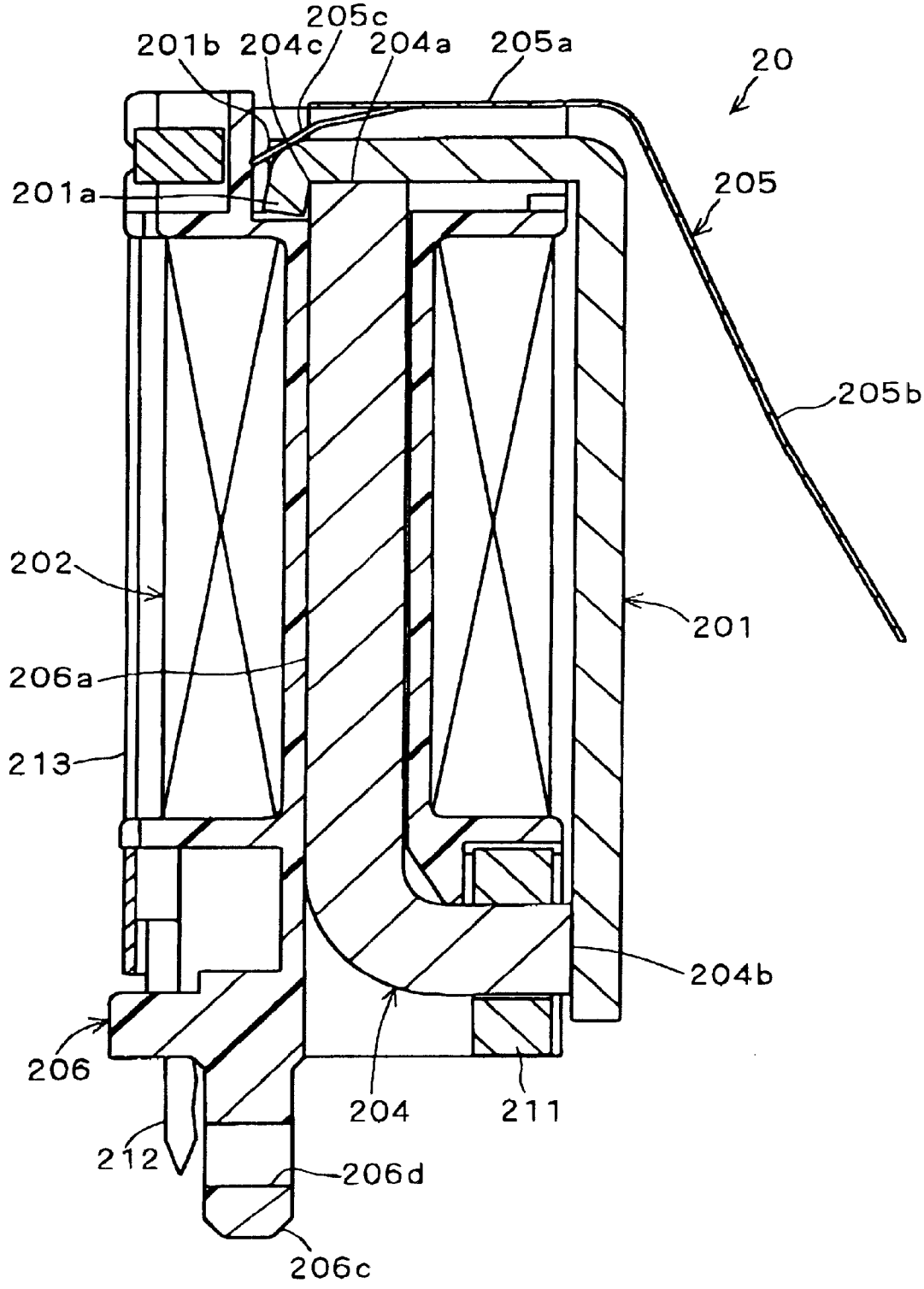
FIG. 7 is a sectional view showing the coil unit.

Two portions on right and left sides of an upper end side edge are bent downward on an end at the upper end side of the armature 201 so that two engagement portions 201*a* are provided. A straight portion 201*b* is provided in a middle portion of both engagement portions 201*a*. As shown in FIG. 7, consequently, when the armature 201 is attached to the core 204 fixed to the bobbin 206, the engagement portion 201*a* is engaged With an edge portion 204*c* of the end face 204*a* to hold the end face 204*a* on the upper end side from above.

Figure 9:
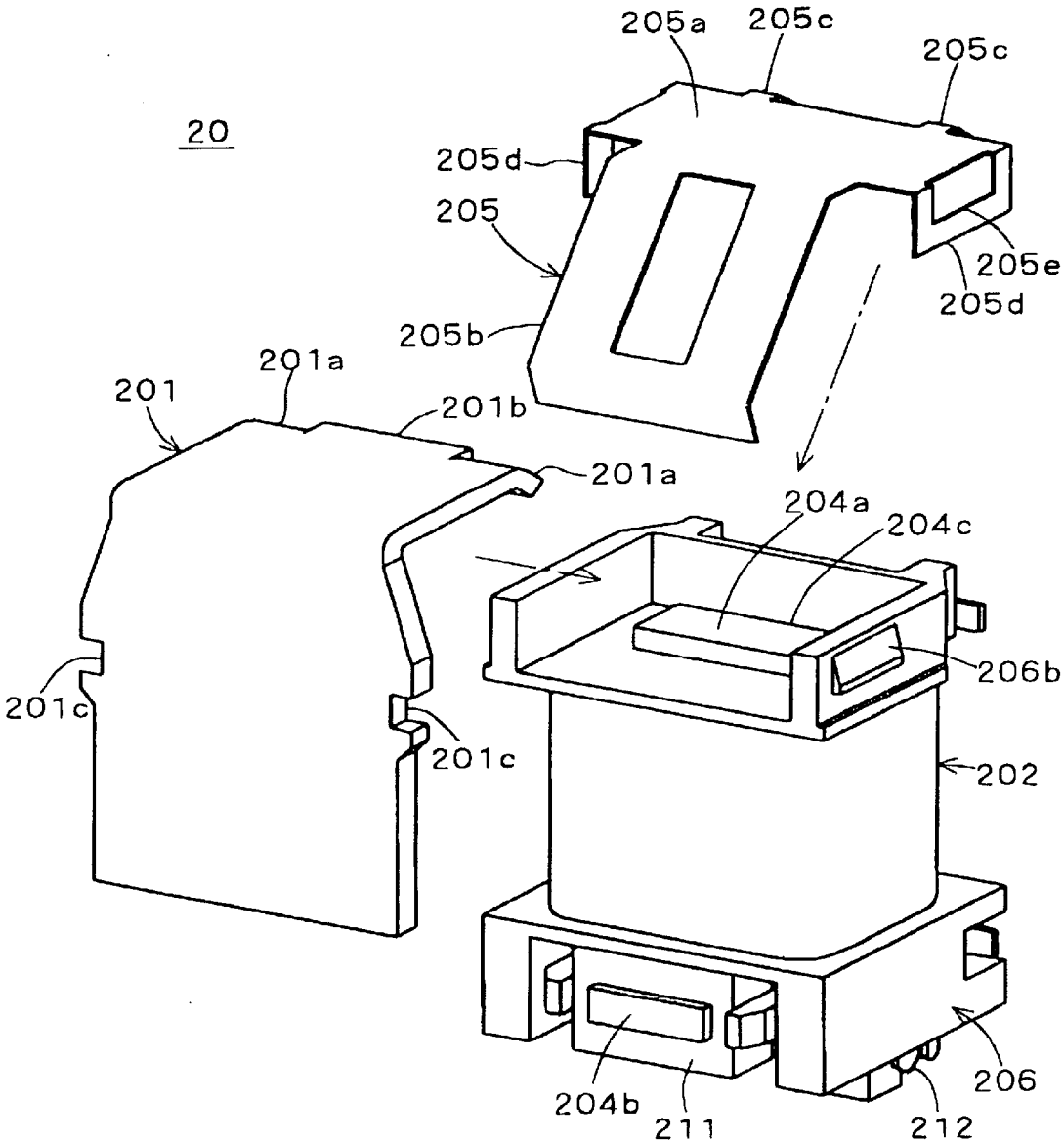
FIG. 9 is an exploded perspective view showing the coil unit.

As shown in FIG. 9, the hinge spring 205 is integrally formed of a metal plate piece through punching molding and bending formation and comprises, as components, a rectangular plate-shaped body 205*a*, a return spring piece 205*b* extended obliquely downward from a front end of the body 205*a*, an energizing spring piece 205*c* extended obliquely downward from right and left sides of a rear end of the body 205*a*, and a fixing piece 205*d* (a first engagement portion) extended downward from right and left ends of the body 205*a*.

The return spring piece 205*b* of the hinge spring 205 serves to energize and restore the card 104 and the armature 201 in such a direction that the common contact 103*a* abuts on the normally-closed contact 101*a*. As shown in FIG. 4, the card 104 and the armature 201 are engaged with each other through engagement portions 104*a* and 201*c*. Therefore, the return spring portion 205*b* energizes the card 104, thereby indirectly energizing the armature 201.

Both energizing spring pieces 205*c* serve to energize and rockably hold the armature 201.

Both fixing pieces 205*d* serve to fix the hinge spring 205 to the bobbin 206 and an engagement hole 205*e* is provided thereon respectively. Correspondingly, right and left side surfaces on the upper end of the bobbin 206 are provided with an engagement convex portion 206*b* (a second engagement portion) to be engaged with the engagement hole 205*e* of each of the fixing pieces 205*d*. The hinge spring 205 is fixed through attachment to the upper end of the bobbin 206 from above to engage the engagement holes 205*e* of the fixing pieces 205*d* with the engagement convex portion 206*b* in a state in which the armature 201 is attached to the upper end of the core 204 as described above.

In the attachment state, as shown in FIG. 7, both engagement portions 201*a* of the armature 201 are energized toward the edge portion 204*c* of the core 204 through both energizing spring pieces 205*c* of the hinge spring 205. Consequently, the armature 201 is held to be freely rocked and displaced by setting an abutment portion of the engagement portion 201*a* and the edge portion 204*c* as a hinge portion (an axis). The armature 201 is rocked and displaced such that a lower end approaches to or separates from the end face 204*b* on the lower end side of the core 204 depending on an excitation of the coil 204.

In the attachment state, moreover, when the lower end is sucked, the upper end of the armature 201 causes an outer peripheral surface thereof to abut on the end face 204*a* at the upper end side of the core 201 in a close contact state.

Figure 8:
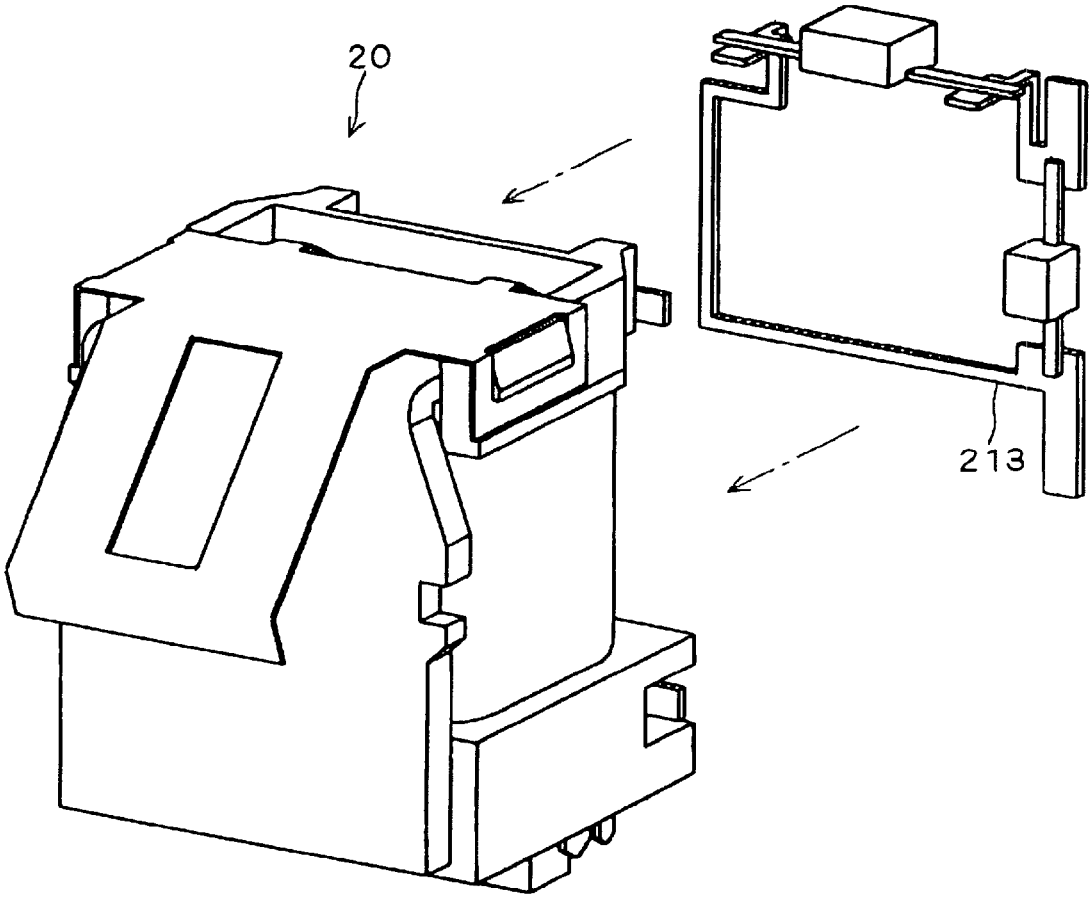
FIG. 8 is an exploded perspective view showing the coil unit.

As shown in FIGS. 3, 8 and 10, the back side of the bobbin 206 is provided with a connecting terminal 212 for connecting the coil 202 and the coil terminal 203 and a connecting circuit 213 for connecting a display portion 230 for displaying a state of conduction of the coil 202 (see FIG. 17) to the coil terminal 203 through the connecting terminal 212. The display portion 230 is provided on the upper end of the coil unit 20. A circuit structure of the display portion 230 will be described below.

<Structure of Abutment Portion on Lower End Side of Core and Armature>

This portion will be described with reference to FIGS. 12 and 13. A shading coil 211 is attached to the end at the lower end side of the core 204 to prevent beats or the like from being caused by application of an AC signal to the coil 202 and to stably drive the armature 201. The shading coil 211 is fixed by forming a holding trench 204*d* on right and left ends of the end face 204*b* on the lower end side of the core 204 and inserting, pressing and holding the shading coil 211 into the holding trench 204*d*.

In order to effectively remove the beats or the like, it is necessary to set, to a proper ratio, an area ratio of an inner peripheral pole surface 204*e* positioned on the inside and outside of the shading coil 211 to each outer peripheral pole surface 204*f* in the end face 204*b* on the lower end side of the core 204. In order to obtain a desirable characteristic, therefore, it is necessary to fully reduce a size of each outer peripheral pole surface 204*f* with respect to a size of the inner peripheral pole surface 204*e* in some cases. However, if the size of the outer peripheral pole surface 204*f* is simply reduced, a radial thickness of the coil 211 of a holding piece portion (an outer peripheral portion) 204*g* for holding the shading coil 211 on the outside of the holding trench 204*d* is also reduced so that a mechanical holding strength of the holding piece portion 204*g* might be damaged.

Figure 12:
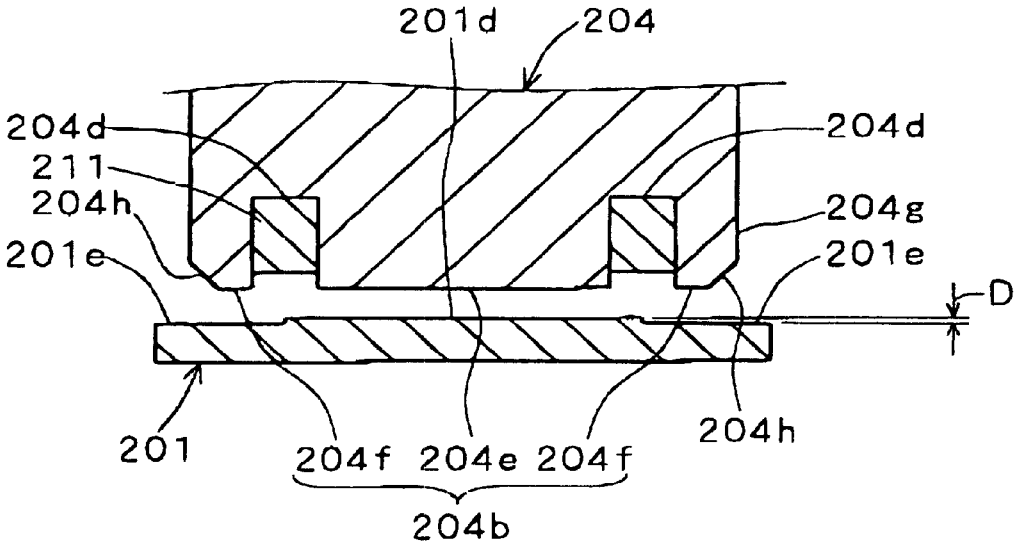
FIG. 12 is a sectional view showing a structure of an abutment portion on the lower end side of a core and the armature.

In the present embodiment, an outer peripheral side edge portion of each outer peripheral pole surface 204*f* is chamfered to form a chamfered portion 204*h* as shown in FIGS. 10 and 12. Consequently, it is possible to correspond to a reduction in the size of the outer peripheral pole surface 204*f* while fully maintaining the thickness of the holding piece portion 204*g*.

In order to prevent a looseness when the core 204 and the armature 201 are sucked, moreover, it is preferable that the core 204 should substantially abut on the armature 201 in three points during the suction.

On the other hand, in the present embodiment, the two engagement portions 201*a* of the armature 201 are engaged with (abut on) the edge portion 204*c* of the core 204 in two right and left portions on the upper end side of the core 204. Therefore, it is preferable that the core 204 should substantially abut on the armature 201 in one place at the lower end side of the core 204. Accordingly, it is necessary to select one of three abutment surfaces of the inner peripheral pole surface 204*e* and both outer peripheral pole surfaces 204*f* in the core 204 to abut on the armature 201.

Figure 14:
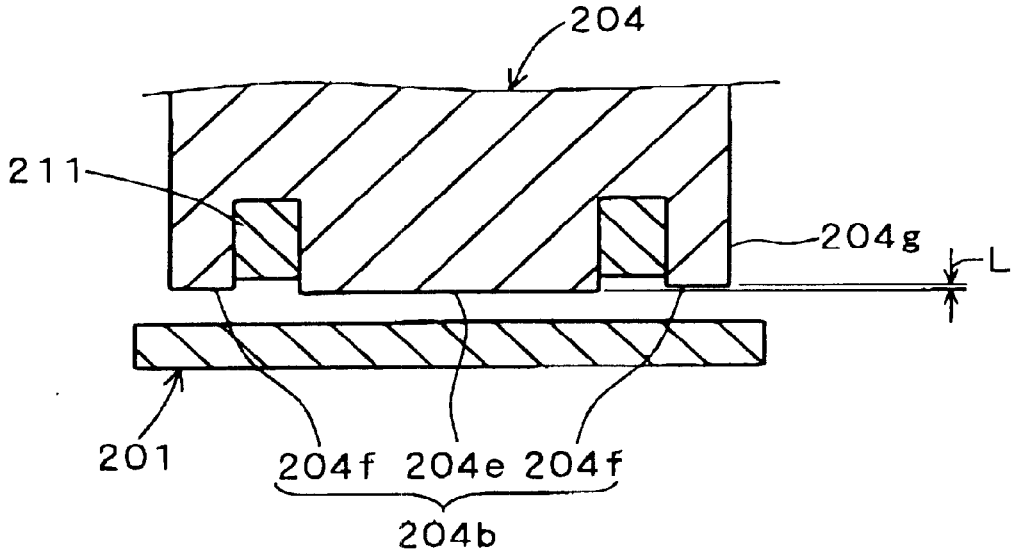
FIG. 14 is a sectional view showing a structure of an abutment portion of a core and an armature according to the conventional art.

As shown in FIG. 14, conventionally, the positions of both outer peripheral pole surfaces 204*f* of the core 204 are moved backward from the inner peripheral pole surface 204*e* by a predetermined distance L such that only the inner peripheral pole surface 204*e* of the core 204 abuts on the armature 201. However, even if the distance L by which both outer peripheral pole surfaces 204*f* are to be moved backward is set accurately during the manufacture of the core 201, a deviation is generated on a set value of the distance L due to deformation of the holding piece portion 204*g* which is caused when the shading coil 211 is attached by pressure Therefore, it is hard to carry out accurate setting. Thus, in the case in which a step shape is to be provided on the core 204 side, a cutting process or the like is carried out. The cutting process also has a drawback that precision in the distance L is reduced.

Figure 13:
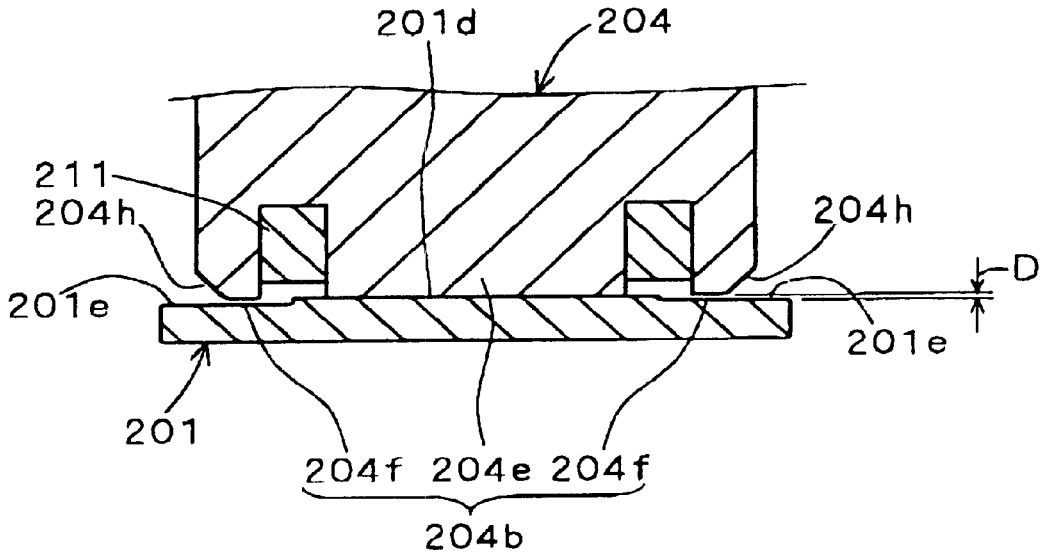
FIG. 13 is a sectional view showing the structure of the abutment portion on the lower end side of the core and the armature.

In the present embodiment, a relieve concave portion 201*e* having a predetermined depth D is provided in portions opposed to both outer peripheral pole surfaces 204*f* of the core 204 in a surface 201*d* opposed to the end face 204*b* on the lower end side of the core 204 at the lower end side of the armature 201 respectively as shown in FIG. 12, and only the inner peripheral pole surface 204*e* in the end face 204*b* on the lower end side of the core 204 abuts on the armature 201 as shown in FIG. 13.

In the present embodiment, the step shape is not provided on the core 204 side but the armature 201 side. Therefore, press molding (face pressing) which is simple and has high processing precision can be employed for a method of forming the relief concave portion 201*e*. Consequently, the relief concave portion 201*e* can easily be formed to have the predetermined depth D with high precision.

<Structure of Contact Unit>

Figure 15:
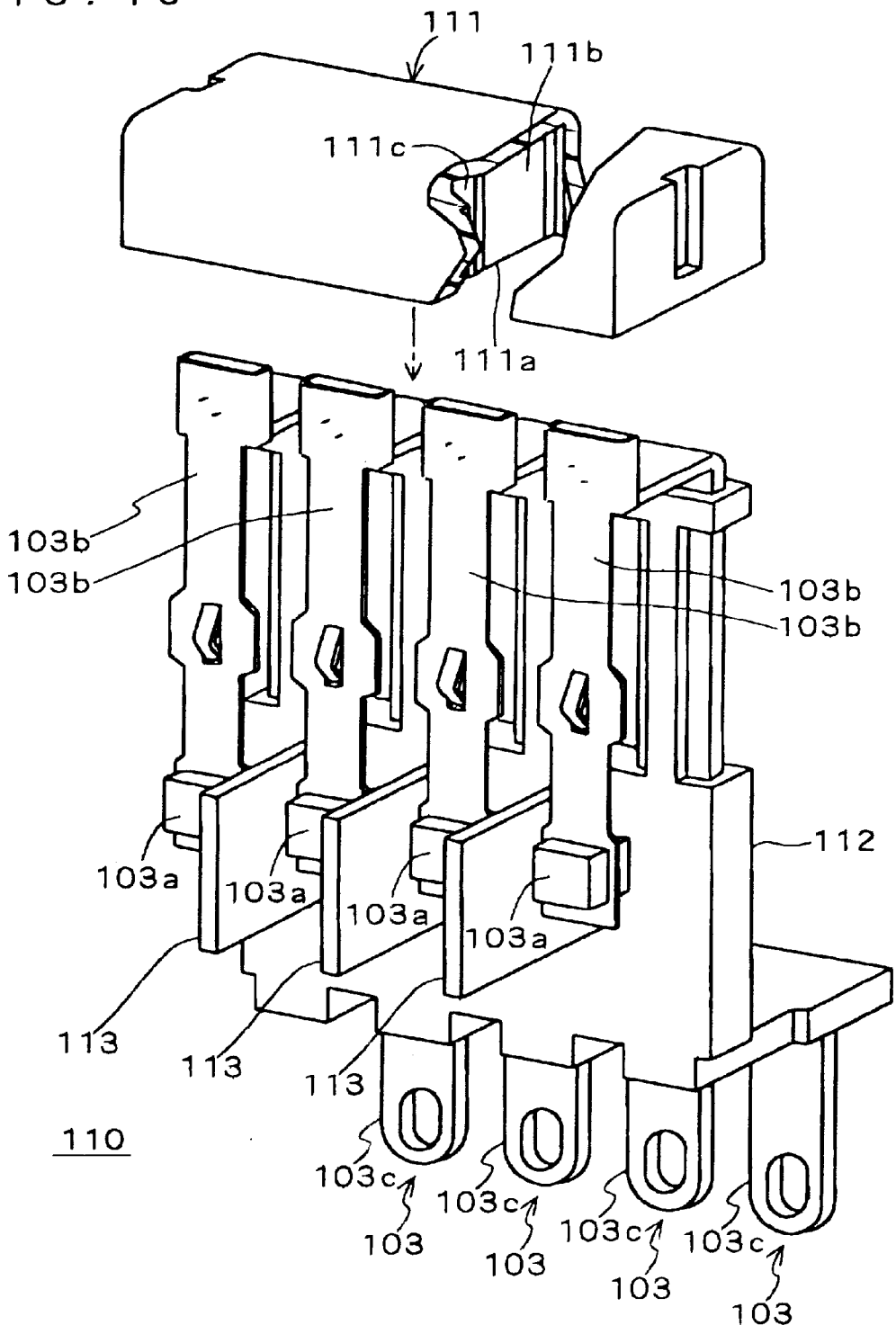
FIG. 15 is an exploded perspective view showing a structure of a common unit, a part of which is taken away.

This portion will be described with reference to FIG. 15. A common unit 110 includes the common terminal portion 103 and a common guard 111. The common terminal portion 103 has a common terminal 103*c* extended vertically, the movable spring 103*b* fixed to an upper end of the common terminal 103*b* to be extended downward from the same upper end, and the common contact 103*a* provided on a lower end of the movable spring 103*b*.

A middle portion in a longitudinal direction of the common terminal 103*c* is buried in a base 112 formed of a resin. A plurality of plate-shaped arc barriers 113 are provided integrally with the base 112. The arc barriers 113 serve to block each contact portion where each common contact 103*a* is provided adjacently, thereby preventing a short circuit from being generated by an arc discharge between adjacent terminals. Thus, the arc barriers 113 are provided integrally with the base 103*c* so that the number of parts and an assembly man-hour can be reduced.

The common guard 111 is a cap-shaped member to be attached to the upper end of the common terminal 103*c* and an inside thereof is partitioned by a plurality of insulating ribs 111*a* to provide a plurality of housing spaces 111*b* opened downward in which the upper ends of the common terminals 103*c* are to be inserted. A positioning trench 111*c* for fitting the upper end of the common terminal 103*c* therein is provided in each housing space 111*b*.

Such a common guard 111 is attached to the upper end of the common terminal 103*c* so that a short circuit can be effectively prevented from being caused by a discharge between the terminals 103*a* adjacent to the insulating ribs 111*a*. Moreover, the insulating rib 111*a* is positioned between the common terminals 103*c* to have the function of positioning, and the trench 111*c* for positioning each housing space 111*b* can correct a variation in positions where each common terminal 103*c* and each movable spring 103*b* are to be provided (in particular, a variation in a direction of movement of the movable spring 103*b*).

Figure 5:
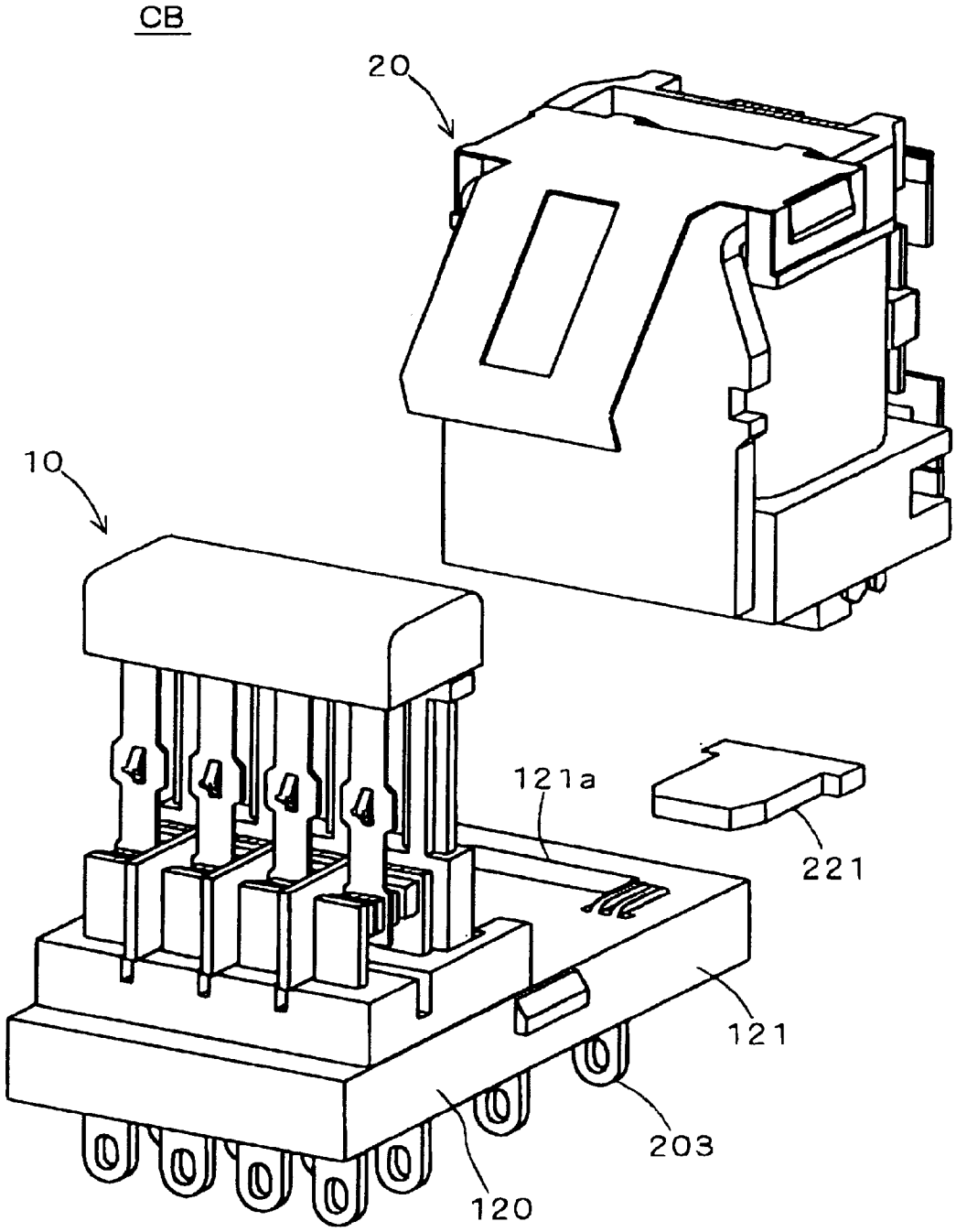
FIG. 5 is an exploded perspective view showing the coupled body.

The common unit 110 having such a structure can be assembled into a base 120 of the contact unit 10 as shown in FIG. 5.

<Structure of Assembly of Coil Unit>

This portion will be described with reference to FIG. 16. The base 120 constituting a bottom of the contact unit 10 is extended from the bottom of the contact unit 10 toward the rear side (the left side of FIG. 16) and the coil unit 110 is assembled into an extended portion 121. A through hole 121*a* penetrating vertically is provided on the extended portion 121. A housing concave portion 121*c* for accommodating a fixing member 221 which will be described below is provided on the lower face side of the extended portion 121.

An inserting portion 206*c* to be inserted into the through hole 121*a* of the extended portion 121 is provided integrally with the bottom of the bobbin 206 of the coil unit 20. The inserting portion 206*c* is provided with an insertion hole 206*d* in which the fixing member 221 (a wedge member) is to be inserted.

The coil unit 20 is assembled as follows. In a state in which the inserting portion 206*c* of the coil Unit 20 is inserted from above into the through hole 121*a* of the extended portion 121, the fixing member 221 is pushed into the insertion hole 206*d* on the lower face side of the extended portion 121 so that the inserting portion 206*c* can be prevented from slipping out. As shown in FIG. 1, consequently, the coil unit 20 and the contact unit 10 are coupled and fixed to each other in a longitudinal butt state.

In the assembly state, a convex portion 121*b* extended from an upper surface of the extended portion 121 abuts on the lower end of the core 204 as shown in FIG. 1. Consequently, the core 204 can be prevented from slipping out of the bobbin 206.

With the assembly of the coil unit 20, moreover, the connecting terminal 212 attached to the coil unit 20 and the coil terminal 203 attached to the extended portion 121 are fitted and connected to each other.

<Structure of Contact Operating Mechanism>

Figure 17:
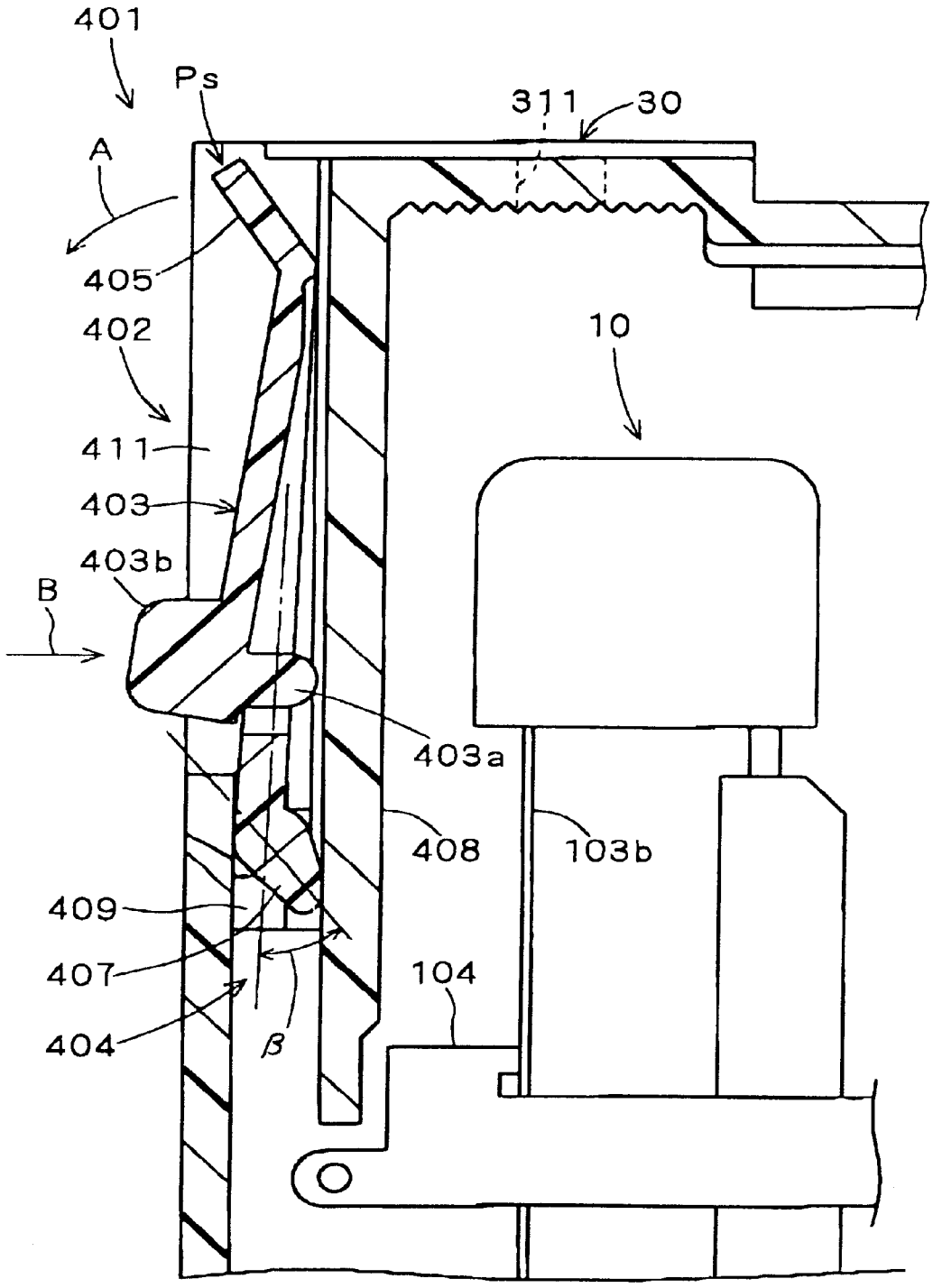
FIG. 17 is a sectional view showing a structure of a contact operating mechanism.
Figure 18:
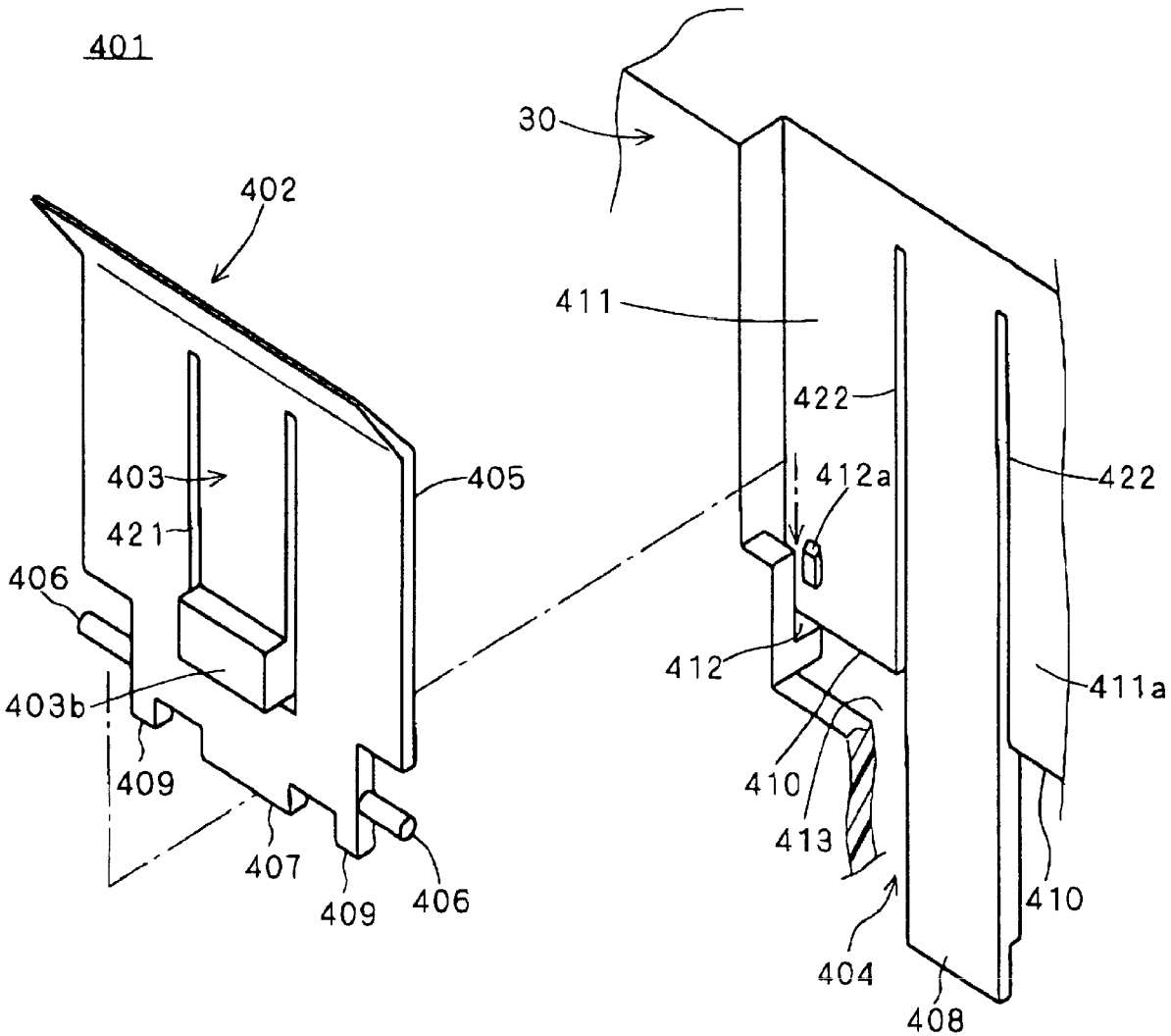
FIG. 18 is an exploded perspective view showing the contact operating mechanism.

The case 30 for accommodating the coupled body CB is provided with a contact operating mechanism 401 for forcibly switching the common contact 103*a* from the outside as shown in FIG. 1. The contact operating mechanism 401 includes an operation lever 402 pivotally supported rotatably on the case 30, a flexible operating portion 403 provided integrally with the operation lever 402, and a lock structure 404 as shown in FIGS. 17 and 18.

The operation lever 402 is a resin molded member which wholly takes the shape of an almost plate, and includes, as components, an almost rectangular plate-shaped operating portion 405, a shaft portion 406 protruded to the right and left from both side surfaces on a lower end of the operating portion 405, and a working portion 407 protruded downward from the center of the lower end of the operating portion 405.

The flexible operating portion 403 is integrally formed with an almost U-shaped nick 421 provided in an almost central part of the operating portion 405 of the operation lever 402 and has the shape of a leaf spring extended like a cantilever from an upper end of the operating portion 405. Consequently, when a lower end of the flexible operating portion 403 is pressed, the flexible operating portion 403 is elastically flexed and deformed from a natural state. Projections 403*a* and 403*b* are provided on both surfaces of the lower end of the flexible operating portion 403. The projection 403*a* serves to press a leaf spring 408 of the lock structure 404 which will be described below and the projection 403*b* serves to press the flexible operating portion 403.

The lock structure 404 includes a leaf spring 408 (an elastic member) provided integrally with the case 30 to be a resin molded member, and first and second engagement portions 409 and 410 provided in the operation lever 402 and the case 30.

A housing concave portion 411 for accommodating the operation lever 402 is provided in a portion (a side surface portion) turning a back thereof on the terminal unit 10 at an external surface of the case 30. A concave portion 412 for a bearing which is opened upward to rotatably hold both shaft portions 406 of the operation lever 402 is provided on right and left sides of a lower end of the housing concave portion 411. A projection 412*a* for preventing the shaft portion 406 inserted in the concave portion 412 from slipping off is provided in an opening of each concave portion 412. Moreover, the center of the lower end of the housing concave portion 411 is provided with an opening 413 in which the working portion 407 and the first engagement portion 409 in the operation lever 402 are to be inserted.

The leaf spring 408 of the lock structure 404 is provided integrally with the case 30 with two nicks 422 extended vertically at a predetermined interval over a bottom wall portion 411*a* of the housing concave portion 411 of the case 30, and is extended like a cantilever downward from an upper end in a central part of the housing concave portion 411. A lower end of the leaf spring 408 is extended to a position where it can abut on a left end of the card 104 shown in FIG. 1.

The first engagement portion 409 of the lock structure 404 is protruded to right and left ends in a lower end portion of the operating portion 405 of the operation lever 402. Moreover, the second engagement portion 410 is constituted by right and left ends on a lower edge of the bottom wall portion 411*a* of the housing concave portion 411 facing the opening 413.

Figure 19:
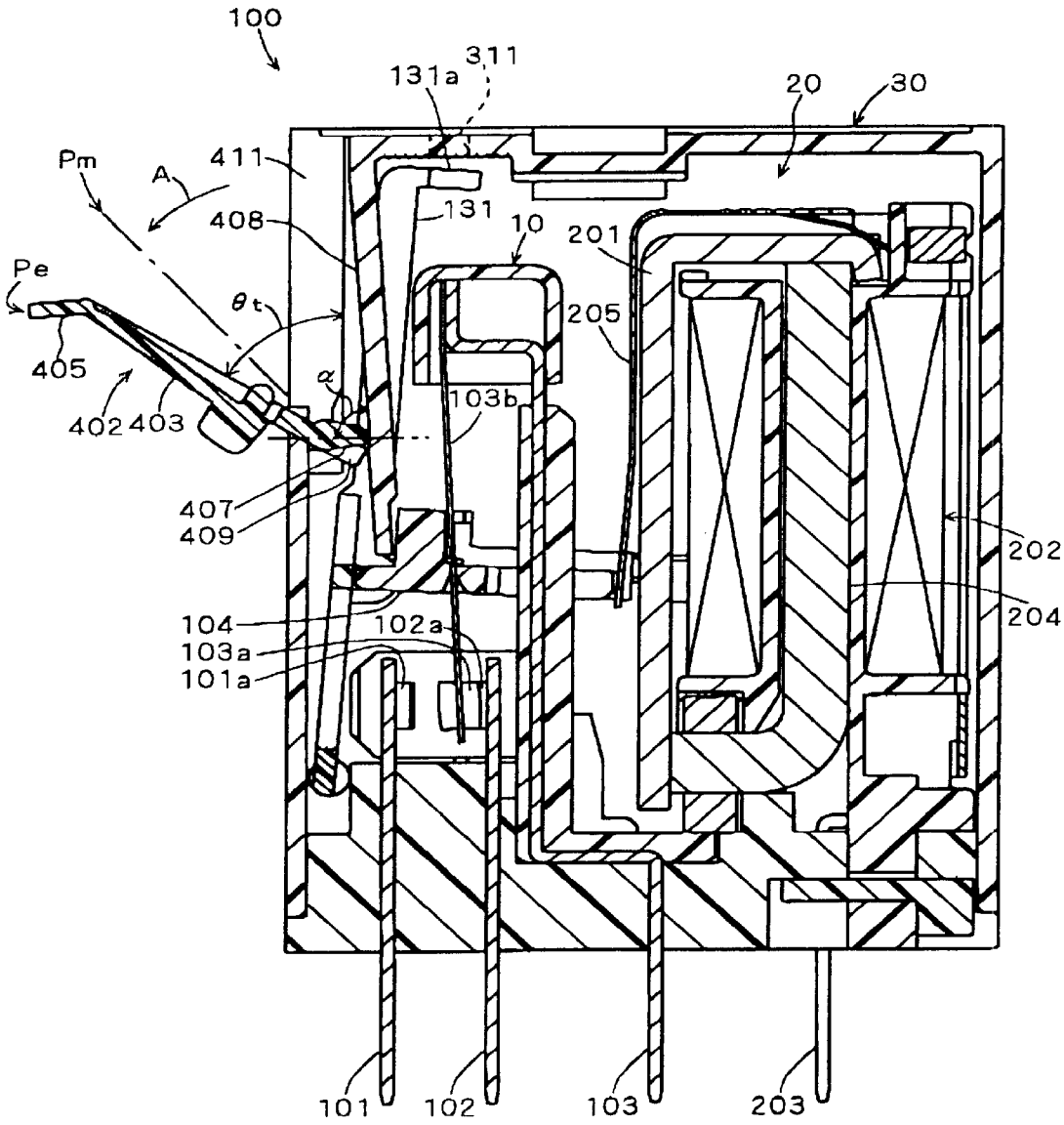
FIG. 19 is a sectional view showing a fixed mode.

The operation lever 402 is attached to the case 30 by pressing both shaft portions 406 into both concave portions 412 of the housing concave portion 411, and is thereby supported rotatably around the shaft portion 406 as shown in an arrow A of FIG. 17. In the attachment state, the working portion 407 of the operation lever 402, the projection 403*a* of the flexible operating portion 403 and the leaf spring 408 of the case 30 have such a positional relationship that they can abut each other. As shown in FIG. 19, moreover, the first engagement portion 409 and the second engagement portion 410 in the operation lever 402 have such a positional relationship that they can be engaged with each other when the operation lever 402 is rotated up to a forced position Pe as will be described below. The engagement of the first and second engagement portions 409 and 410 can stop the rotation of the operation lever 402 in a direction of an arrow A.

When the operation lever 402 is rotated in the direction of the arrow A from a stop position (a stop attitude) Ps shown in FIG. 17 to the forced position (a forced state) Pe shown in FIG. 19, the leaf spring 408 is pressed and is elastically flexed and deformed inwardly through the working portion 407 of the operation lever 402 as shown in FIG. 19. Consequently, the card 104 is pressed and moved rightwards in FIG. 19 through the lower end of the leaf spring 408 so that the common contact 103*a* is separated from the normally-closed contact 101*a* to abut on the normally-opened contact 102*a*. In the stop position Ps, the operation lever 402 is set in an almost parallel state with a side surface of the case 30 (the bottom wall portion 411*a* of the housing concave portion 411) and is erected perpendicularly to a direction of movement of the card 104.

The working portion 407 is protruded to be bent from. the lower end of the operating portion 405 toward the leaf spring 408 side, and a bending angle β (see FIG. 17) is determined to satisfy the following conditions. More specifically, a rotation torque to be applied to the operation lever 402. through the working portion 407 by the pressing force of the leaf spring 408 acts on a direction reverse to the direction of the rotation shown in the arrow A when a rotation angle θt of the operation lever 402 ranges from the stop position Ps shown in FIG. 17 to a predetermined middle position (an intermediate attitude) Pm. On the other hand, when the rotation angle θt ranges from the middle position Pm to the forced position Pe shown in FIG. 19, the bending angle β is set to act in the direction of the rotation shown in the arrow A or to be substantially zero.

When the operation lever 402 is set to have an angle ranging from the stop position Ps to the middle position Pm, an angle α at which the working portion 407 abuts on the leaf spring 408 (see FIG. 19) is less than 90 degrees. Consequently, the rotation torque to be applied from the leaf spring 408 to the operation lever 402 acts in the direction reverse to the direction shown in the arrow A. Moreover, when the operation lever 402 is set to have an angle ranging from the middle position Pm to the forced position Pe, the angle α is approximately 90 degrees. Consequently, the rotation torque to be applied from the leaf spring 408 to the operation lever 402 is substantially zero.

Moreover, when the operation lever 402 is set in the stop position Ps, the operating portion 405 abuts on the bottom wall portion of the housing concave portion 411. thereby stopping the rotation in the direction reverse to the direction shown in the arrow A through the rotation torque applied from the leaf spring 408.

Furthermore, when the operation lever 402 is set in the forced position Pe, the rotation torque to be applied from the leaf spring 408 to the operation lever 402 is substantially zero and the rotation of the operation lever 402 in the direction of the arrow A is stopped through the first and second engagement portions 409 and 410 engaged with each other. Therefore, the same state is maintained to bring a locking state until an artificial operation is carried out.

Figure 20:
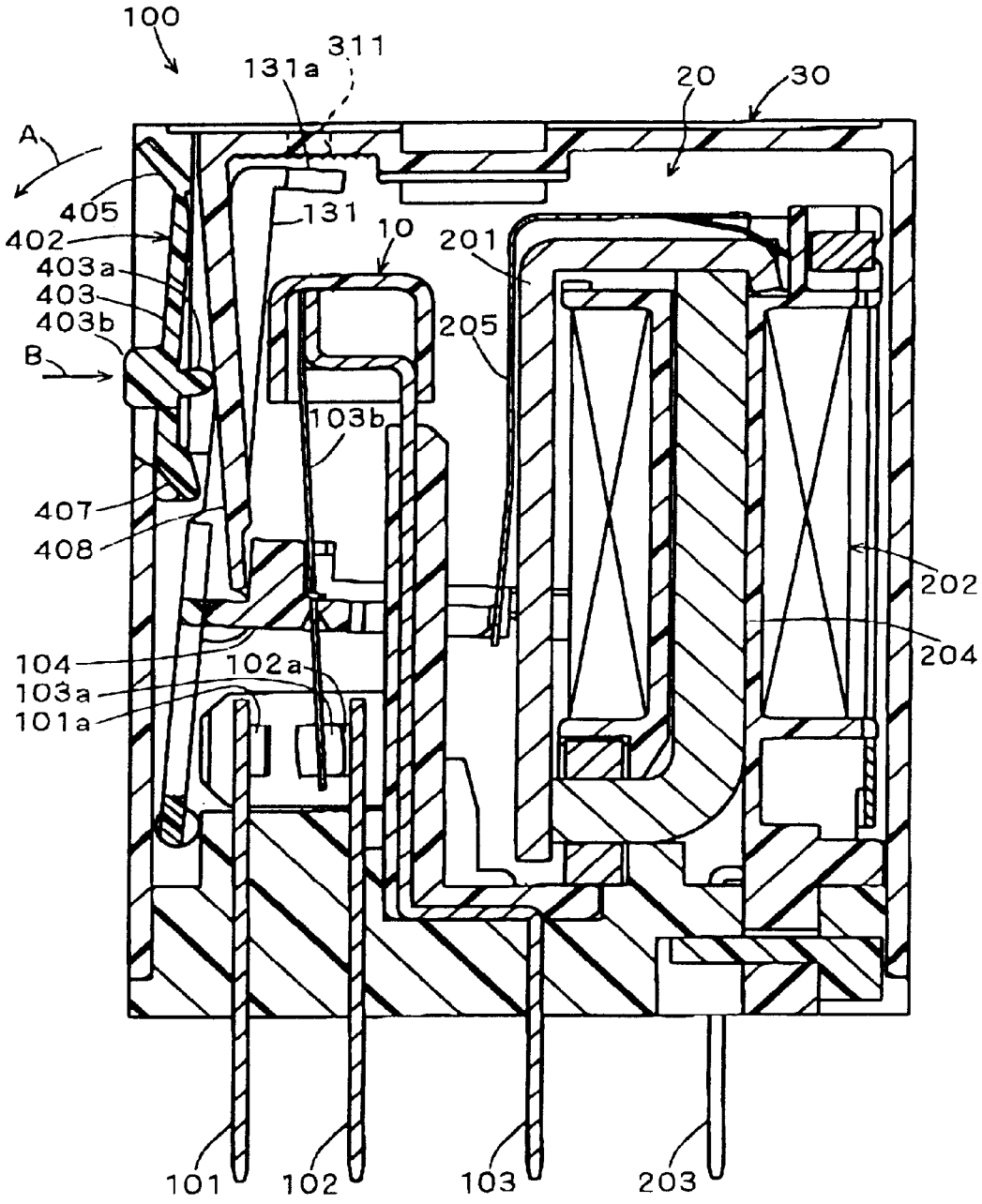
FIG. 20 is a sectional view showing a momentary mode.

Moreover, when the flexible operating portion 403 of the operation lever 402 is pressed in a direction of an arrow B (in the direction reverse to the direction of the rotation shown in the arrow A) as shown in FIG. 20 in a state in which the operation lever 402 is set in the stop position Ps, the flexible operating portion 403 is elastically flexed and deformed toward the inside of the case 30 by the pressing force so that the leaf spring 408 is pressed and is elastically flexed and deformed inwardly through the projection 403*a* Consequently, the card 104 is pressed and moved rightwards in FIG. 20 through the lower end of the leaf spring 408 so that the common contact 103*a* is separated from the normally-closed contact 101*a* to abut on the normally-opened contact 102*a*. Then, the operation for pressing the flexible operating portion 403 is released so that the flexible operating portion 403 is returned to the natural state. Thus, the card 104 and the common contact 103*a* are returned to the state shown in FIG. 1.

With such a structure, when the operation lever 402 is rotated (fixed) from the stop position Ps shown in FIG. 17 to the forced position Pe shown in FIG. 18, an operation mode of the relay 100 is changed from a neutral mode in which the common contact 103*a* is operated according to the excitation of the coil 202 to a fixed mode in which the common contact 103*a* is steadily switched to the normally-opened contact 102*a* side.

The switching from the fixed mode to the neutral mode is carried out by reversely rotating the operation lever 402 to be returned from the forced position Pe to the stop position Ps. More specifically, the leaf spring 408 and the card 104 are returned from the state shown in FIG. 19 to the state shown in FIG. 17 through the reverse rotation of the operation lever 402. It is sufficient that the reverse operation is substantially carried out while the operation lever 402 is moved from the forced position Pe beyond the middle position Pm. Even if the operating force is then released, the operation lever 402 is returned to the stop position Ps by itself with a rotation torque applied from the leaf spring 408 to the operation lever 402.

The fixed mode is not released before the operation lever 402 carries out the reverse rotation. Therefore, the fixed mode is suitable for a test worker to carry out another work with the normally-opened contact 102*a* of the relay 100 set in an ON state in a conduction test for the relay 100 or the like.

Moreover, when the flexible operating portion 403 is pressed in the direction of the arrow B (a momentary operation) as shown in FIG. 20 in a state in which the operation lever 402 is set in the stop position Ps shown in FIG. 17, the operation mode of the relay 100 is switched from the neutral mode to a momentary mode in which the normally-opened contact 102*a* is turned ON for only a period in which the pressing operation is carried out. The momentary mode is suitable for the case in which the normally-opened contact 102*a* of the relay 100 is to be temporarily turned ON.

Figure 21:
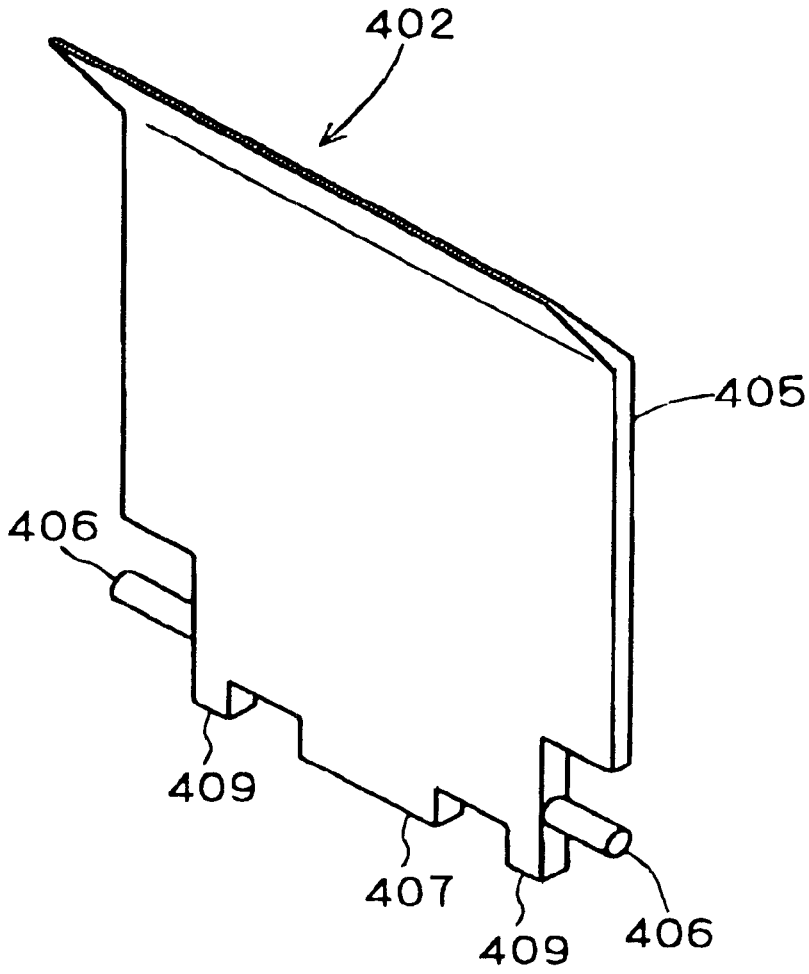
FIG. 21 is a perspective view showing a variant of an operation lever.

While the flexible operating portion 403 is provided integrally with the operation lever 402 in the present embodiment, the flexible operating portion 403 may be omitted as shown in FIG. 21.

<Other Structures>

Furthermore, the card 104 is additionally provided with a display lever 131 for mechanically displaying the operation state of the relay 100 as shown in FIGS. 1 and 2. The display lever 131 has such a structure that an index portion 131*a* provided on an upper end thereof is moved forward and backward on the lower side of a display window portion 311 of the case 30 with the movement of the card 104. With the displacement of the forward or backward movement, the index portion 131*a* appears in or disappears from the display window portion 311 so that the operation state of the relay 100 is displayed.

Next, a circuit structure of the display portion 230 for displaying the state of conduction of the coil 202 will be described with reference to FIG. 22. With the circuit structure shown in FIG. 22, the display portion 230 and the coil 202 are connected to the coil terminals 203*a* and 203*b* in a parallel connection state (which will be generally indicated as the reference numeral "203"). The display portion 230 includes light emitting diodes 231 and 232 connected in parallel with each other in opposite directions, and a resistor 233 connected in series to the light emitting diodes 231 and 232. The light emitting diodes 231 and 232 and the resistor 233 are connected to the coil terminals 203*a* and 203*b* in the parallel connection state.

One of the two light emitting diodes 231 and 232 serves to emit light and to display conduction to the coil 202 when a current flows between the terminals 203*a* and 203*b* and the coil 202 is thereby excited. The other light emitting diode 231 or 232 serves to protect another light emitting diode 231 or 232 from a current flowing in a reverse direction due to back electromotive force of the coil 202 or the like.

For example, in the case in which the terminal 203*a* is set to the positive electrode side and the terminal 203*b* is set to the negative electrode side, the light emitting diode 231 is used for display and the light emitting diode 232 is used for protecting the light emitting diode 231. More specifically, in the case in which a current flows from the terminal 203*a* side to the terminal 203*b* side, the current supplied from the terminal 203*a* flows to the coil 202, and furthermore, flows to the terminal 203*b* through the resistor 233 and the light emitting diode 231 so that the light emitting diode 231 is turned ON. In the case in which the current supply is blocked, the back electromotive force is generated from the terminal 203*b* side toward the terminal 203*a* side through the coil 202. However, the reverse current generated by the back electromotive force flows to the resistor 233 through the light emitting diode 232. Therefore, it is possible to prevent the light emitting diode 231 from being broken by the back electromotive force.

To the contrary, in the case in which the terminal 203*b* is set to the positive electrode side and the terminal 203*a* is set to the negative eletrode side, the light emitting diode 232 is used for display and the light emitting diode 231 is used for protection.

Figure 22:
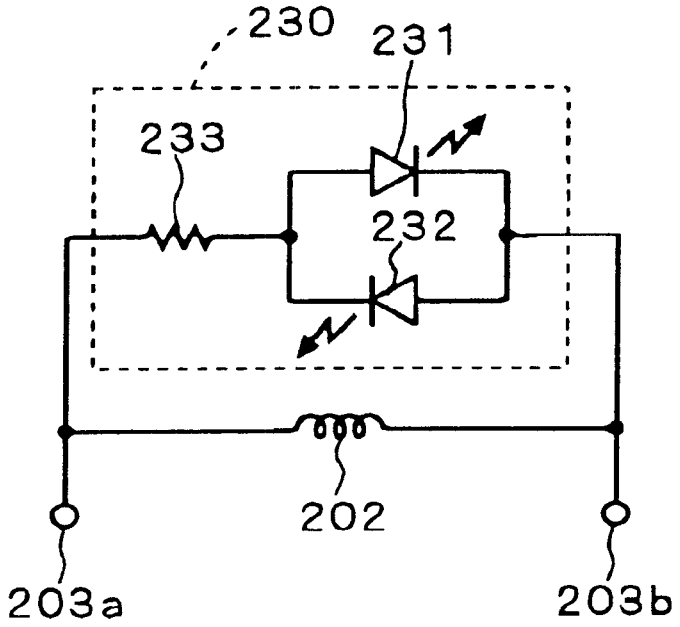
FIG. 22 is a circuit diagram showing a circuit structure of a display portion for displaying a state of conduction of a coil.

With the circuit structure shown in FIG. 22, thus, one of the two light emitting diodes 231 and 232 connected in parallel with each other in opposite directions is used for display and the other light emitting diode 231 or 232 is used for protecting one of them. Therefore, even if any of the coil terminals 203*a* and 203*b* is set to the positive electrode side, the circuit structure does not need to be changed.

Next, a variant of the circuit structure shown in FIG. 22 will be described with reference to FIG. 23. With the circuit structure shown in FIG. 23, the display portion 230 and the coil 202 are connected between the coil terminals 203*a* and 203*b* in a serial connection state. In the display portion 230, moreover, the resistor 233 is connected in parallel with the two light emitting diodes 231 and 232 connected in parallel with each other in opposite directions. Consequently, the two light emitting diodes 231 and 232 and the resistor 233 are provided on an electrical path between the terminals 203*a* and 203*b* in a parallel connection state.

Figure 23:
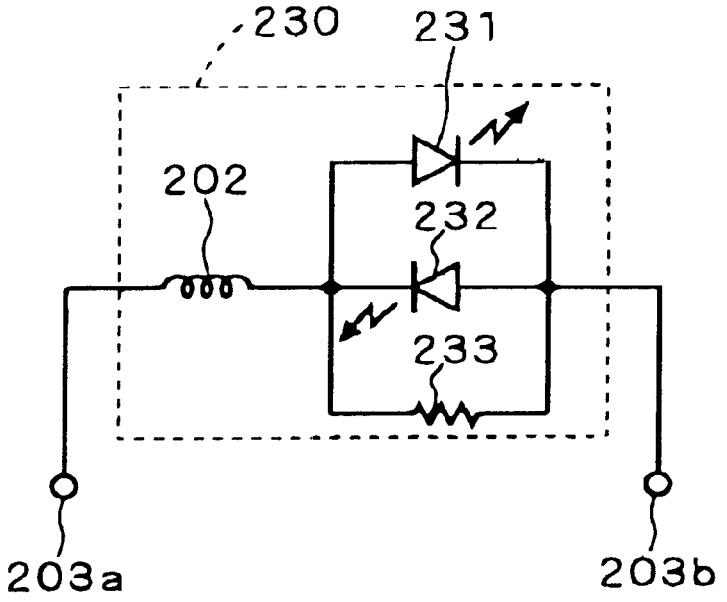
FIG. 23 is a circuit diagram showing a variant of the circuit structure of FIG. 22.

Also in the circuit structure of FIG. 23, even if any of the terminal 203*a* and 203*b* sides is set to the positive electrode side, one of the two light emitting diodes 231 and 232 functions for display and the other light emitting diode 231 or 232 functions for protecting one of them.

<Effect>

As described above, according to the present embodiment, the right and left sides of the upper end side edge of the L-shaped armature 201 are bent to form the engagement portion 201 a and the armature 201 is held to be rocked and displaced through the energizing spring piece 205*c* of the hinge spring 205 in the state in which the engagement portion 201*a* is engaged with the edge portion 204*c* of the end face 204*a* on the upper end side of the core 204 as shown in FIG. 7 and the like. Therefore, the rocking shaft is not shifted and it is possible to stably rock and displace the armature 201 with high precision by using, as the hinge portion, the engagement part of the engagement portion 201 a of the armature 201 and the edge portion 204*c* of the core 204.

With such a structure, moreover, when the lower end is adsorbed magnetically, the outer peripheral surface of the upper end of the armature 201 abuts on the end face 204*a* at the upper end side of the core 201 in a close contact state. Therefore, the leakage flux generated from the end face 204*a* on the upper end side of the core 204 is decreased so that an efficiency can be enhanced.

Figure 6:
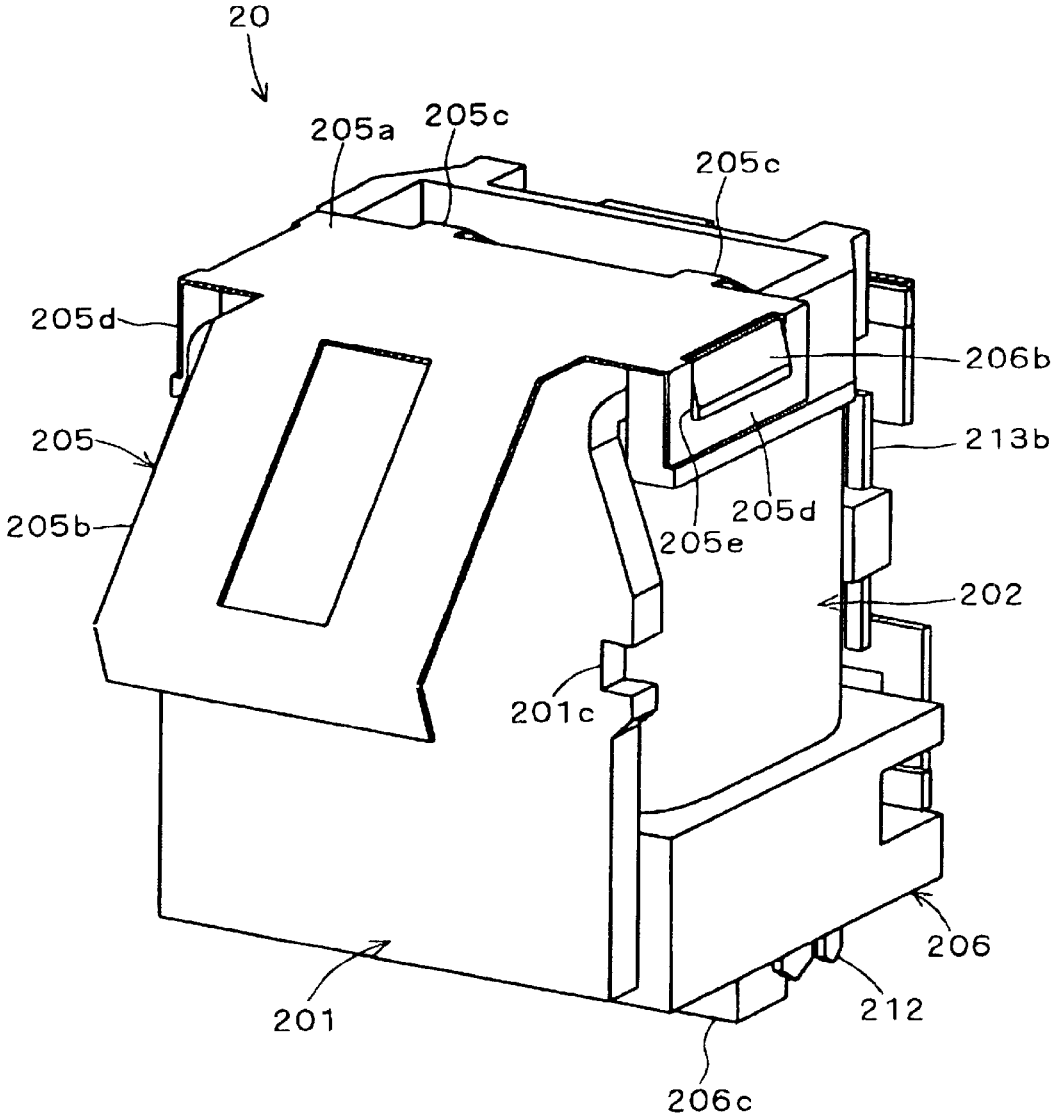
FIG. 6 is a perspective view showing a coil unit.

As shown in FIG. 6 and the like, furthermore, the hinge spring 205 having the function of energizing and holding the armature 201 is fixed to the bobbin 206 through the engagement of the fixing piece 205*d* and the engagement convex portion 206*b* provided on the hinge spring 205 and the bobbin 206 with each other. Therefore, it is possible to easily fix the hinge spring 205 without using a special device. Thus, a process of manufacturing the relay 100 can be simplified and a cost can be reduced.

As shown in FIGS. 10 and 12, moreover, the outer peripheral side edge portion of each outer peripheral pole surface 204*f* in the end face 204*b* on the lower end side of the core 204 is chamfered to form the chamfered portion 204*h*. Consequently, it is possible to reduce the size of the outer peripheral pole surface 204*f* while fully maintaining the thickness of the holding piece portion 204*g* for pressing and holding the shading coil 211.

Figure 16:
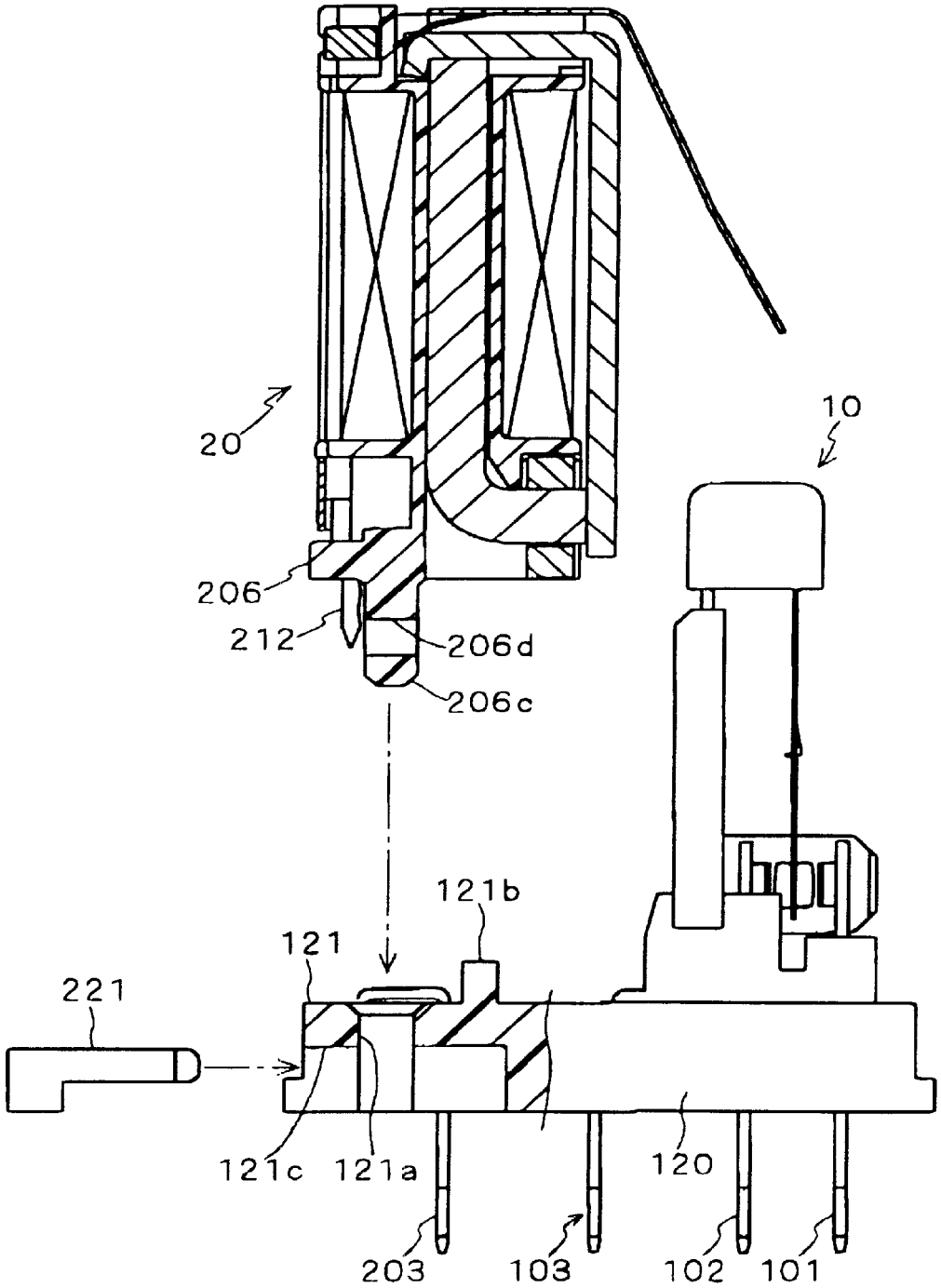
FIG. 16 is a view showing a state of an assembly of a coil unit.

As shown in FIG. 16 and the like, furthermore, when the fixing member 221 is simply pressed into the insertion hole 206*d* on the lower face side of the extended portion 121 in the state in which the inserting portion 206*c* of the coil unit 20 is inserted from above into the through hole 121*a* of the extended portion 121 in the contact unit 10, the coil unit 20 and the contact unit 10 are coupled and fixed to each other. Consequently, the coil unit 20 and the contact unit 10 can be coupled and fixed to each other easily and reliably. Thus, the process of manufacturing the relay 100 can be simplified and the cost can be reduced.

As shown in FIG. 12 and the like, moreover, the step shape for selecting the abutment portion of the core 204 and the armature 201 is not provided on the core 204 side but the armature 204 side. Therefore, the press molding (face pressing) which is simple and has high processing precision can be employed for a method of forming the relief concave portion 201*e* constituting the step shape. Consequently, the relief concave portion 201*e* can easily be formed to have the predetermined depth D with high precision. Thus, the process of manufacturing the relay 100 can be simplified and the cost can be reduced.

In the present embodiment, furthermore, there is provided the contact operating mechanism 401 for forcibly switching the common contact 103*a* from the normally-closed contact 101*a* side to the normally-opened contact 102*a* side by the rotating force applied from the outside, which is convenient for checking the relay 100 and a circuit connected to the relay 100 and the like.

Moreover, when the operation lever 402 carries out the rotating operation (fixing operation) from the stop position Ps shown in FIG. 17 to the forced position Pe shown in FIG. 18, the fixed mode in which the common contact 103*a* is steadily switched into the normally-opened contact 102*a* side is set. Therefore, it is possible for a test worker to carry out another work with the normally-opened contact 102*a* in the relay 100 set in the ON state in the conduction test for the relay 100 and the like, which is convenient.

Furthermore, the fixing operation and the momentary operation represent the operation for rotating the operation lever 402 and the operation for pressing the flexible operating portion 403, and both of them are clearly distinguished from each other and can easily be discriminated. With a simple structure, consequently, it is possible to implement a structure in which an alternate operation and the momentary operation can easily be discriminated.

Moreover, the flexible operating portion 403 for the momentary operation is provided integrally with the operating portion 405 of the operation lever 402 for the alternate operation, and it is not necessary to provide a special part for the momentary operation and an attachment structure for the part. Consequently, the number of parts and an assembly man-hour can be reduced and the structure can be simplified.

Furthermore, when the operation lever 402 is rotated to the forced position Pe shown in FIG. 19, a rotation torque applied from the leaf spring 408 to the operation lever 402 is substantially zero and the first and second engagement portions 409 and 410 provided in the operation lever 402 and the case 30 are engaged with each other so that the rotation of the operation lever 402 in the direction of the arrow A is stopped. Consequently, the operation lever 402 is locked into the forced position 402. Thus, it is possible to constitute the lock structure 404 with a simple structure.

Moreover, when the operation lever 402 is simply rotated reversely from the forced position Pe, the operation lever 402 can be unlocked. Consequently, the operation of the operation lever 402 can be carried out easily.

Furthermore, when the operation lever 402 is to be unlocked, the operation lever 402 is slightly rotated reversely from the forced position Pe and the operation lever 408 is then rotated reversely by itself to the stop position Ps through the rotation torque applied from the leaf spring 408. Therefore, there is an advantage that it is possible to prevent the operation lever 402 from being forgot to return.

<Variant of Contact Operating Mechanism>

Figure 24:
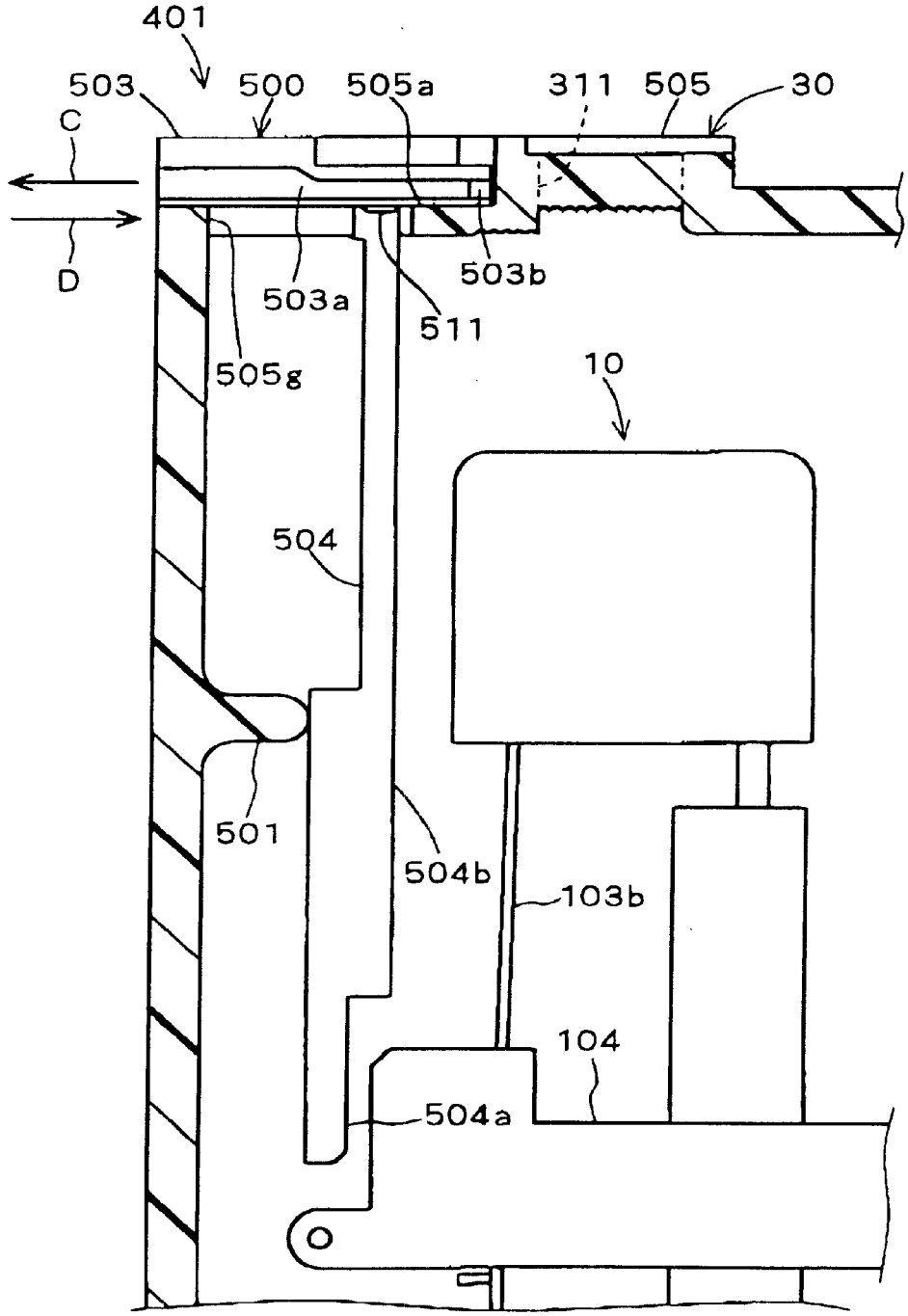
FIG. 24 is a sectional view showing a variant of the contact operating mechanism.

With reference to FIGS. 24 to 34, a variant of the contact operating mechanism 401 will be described. The contact operating mechanism 401 according to the variant includes an operation lever 500 provided slidably in a case 30, a fulcrum portion 501 provided in the case 30 and a lock structure 502 (see FIG. 34 and the like) as shown in FIG. 24 and the like.

Figure 25:
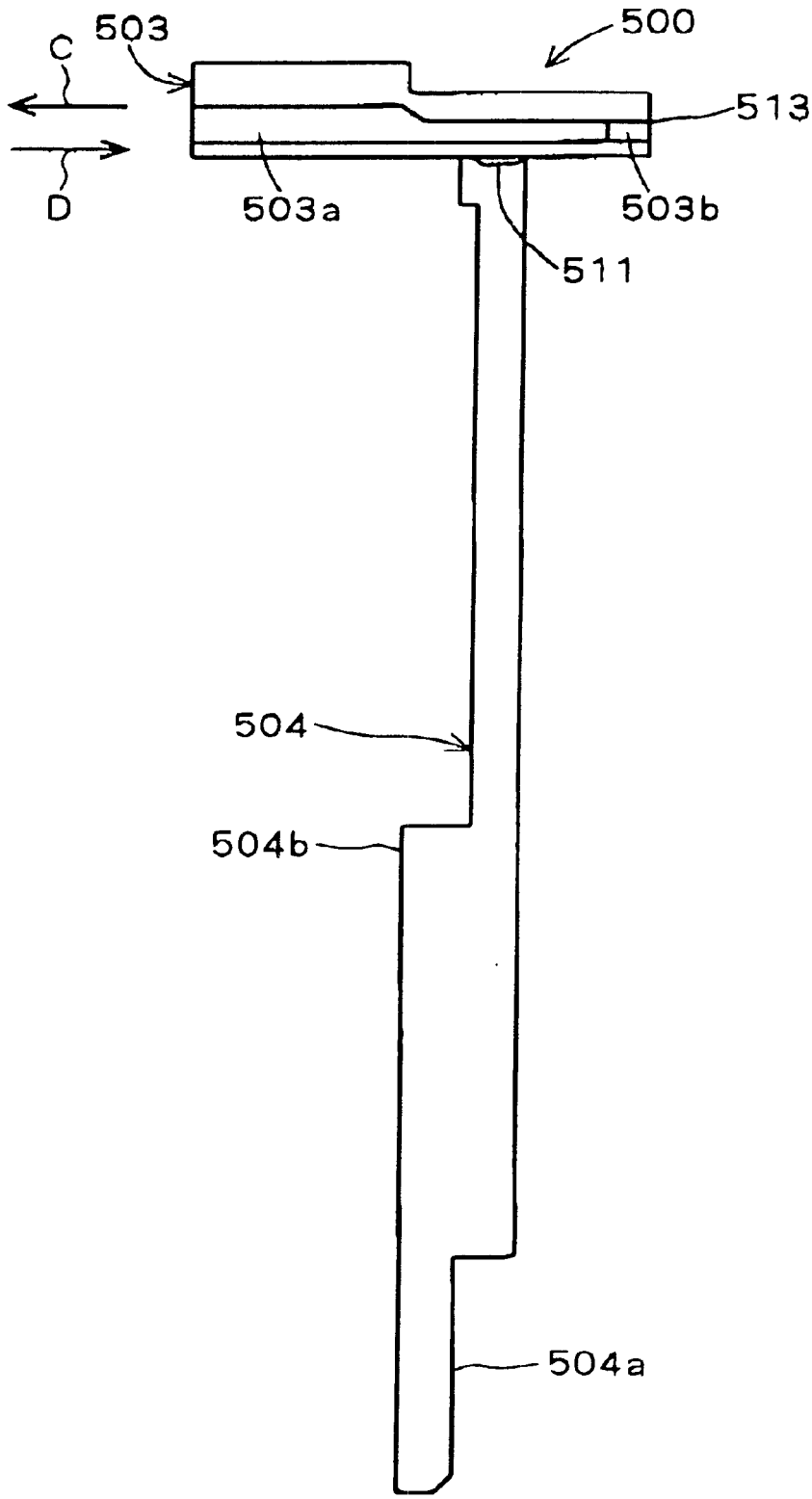
FIG. 25 is a side view showing an operation lever according to the variant of FIG. 24.
Figure 26:
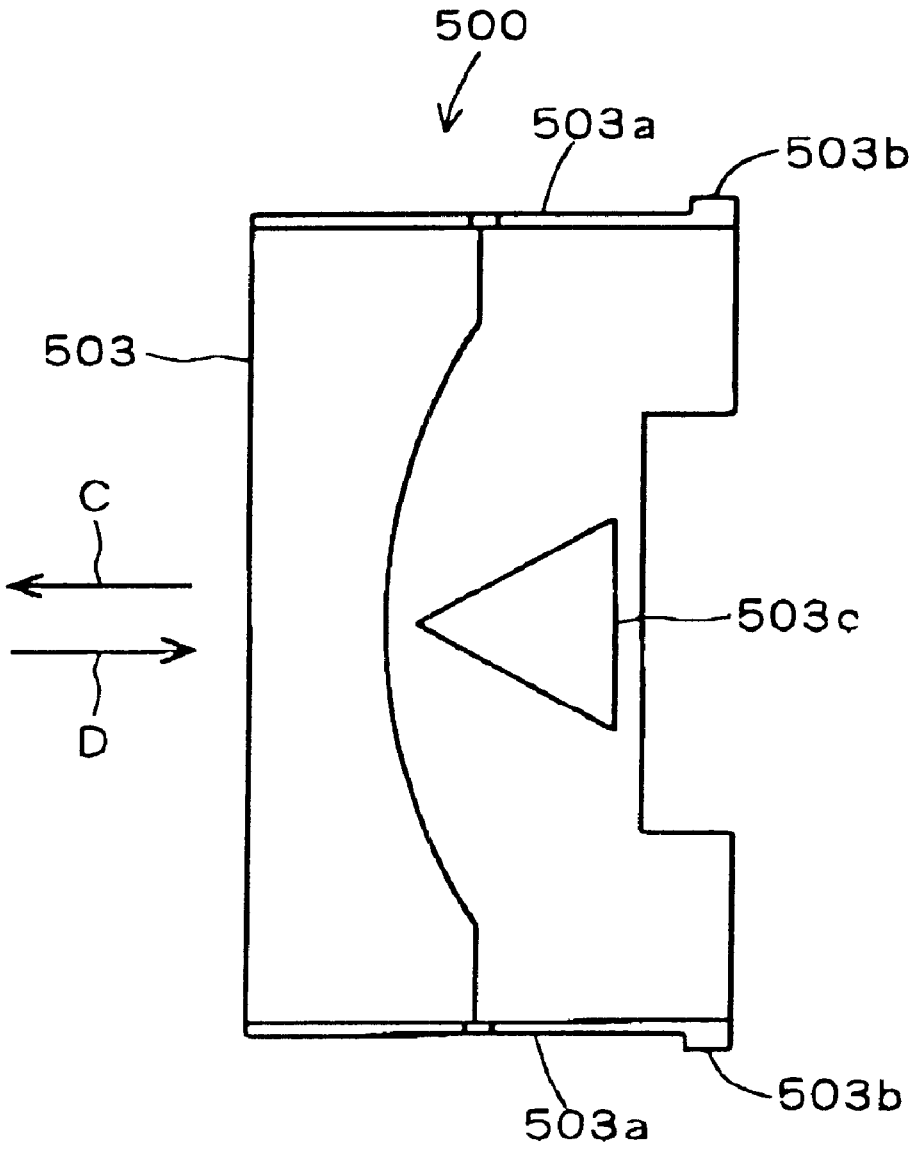
FIG. 26 is a top view showing the operation lever of FIG. 25.

As shown in FIGS. 25 and 26, the operation lever 500 includes an operating portion 503 having the shape of an almost rectangular plate and an operating bar 504 protruded integrally downward from a lower surface of the operating portion 503. The operating bar 504 is protruded from the operating portion 503 in a direction which is almost perpendicular to slide directions C and D of the operating portion 503 and has a predetermined flexibility.

Figure 27:
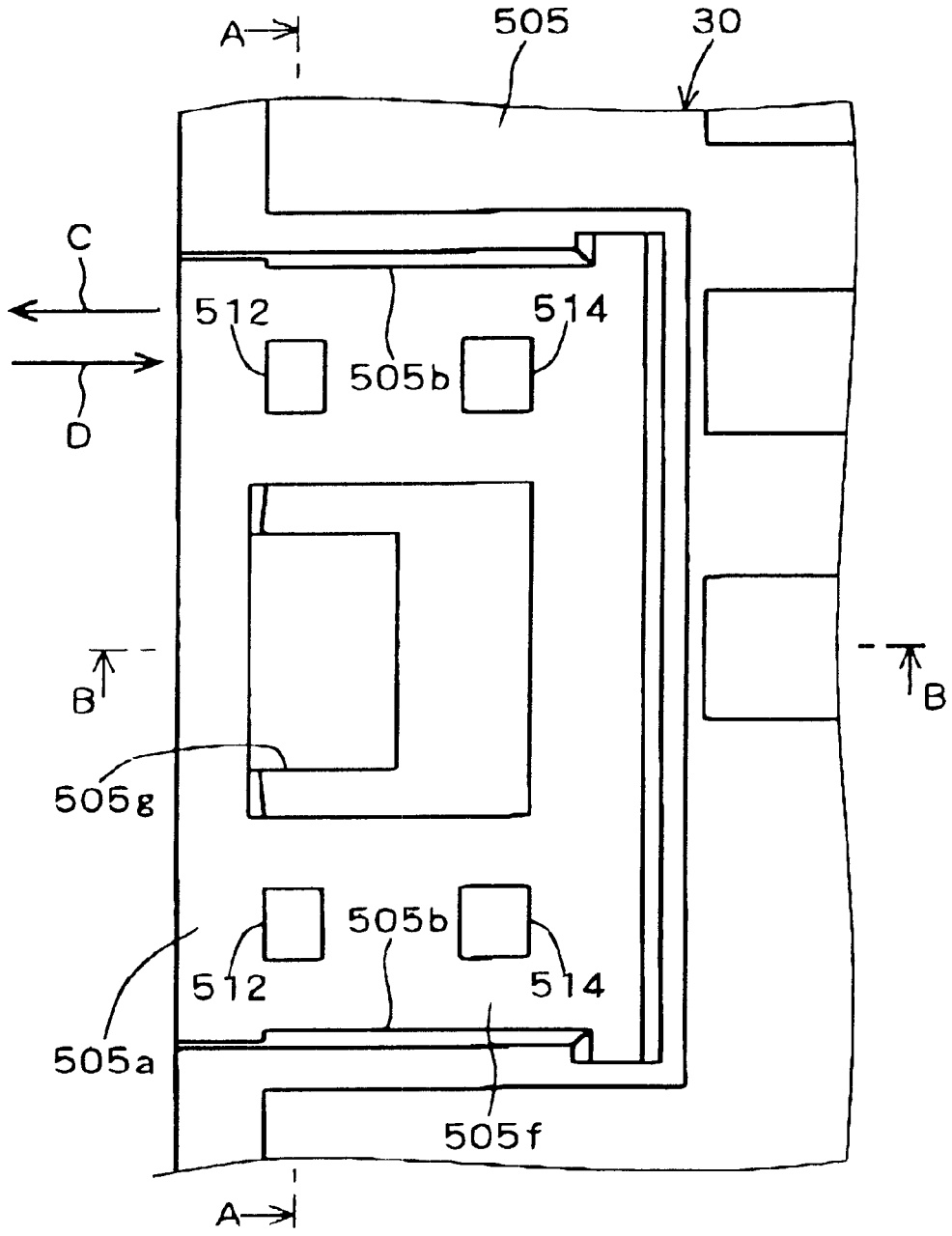
FIG. 27 is a plan view showing a structure of a main part of a case according to the variant of FIG. 24.
Figure 28:
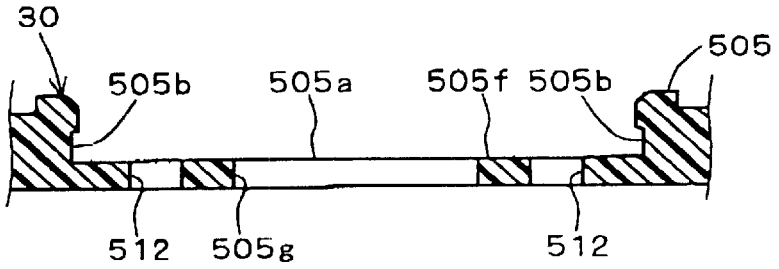
FIG. 28 is a sectional view taken along a line A—A in FIG. 27.
Figure 29:
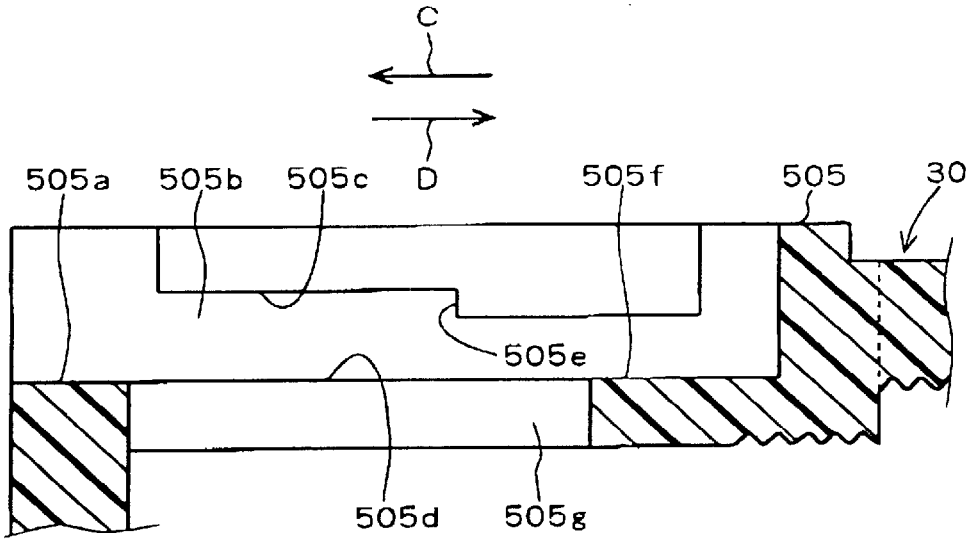
FIG. 29 is a sectional view taken along a line B—B in FIG. 27.
Figure 30:
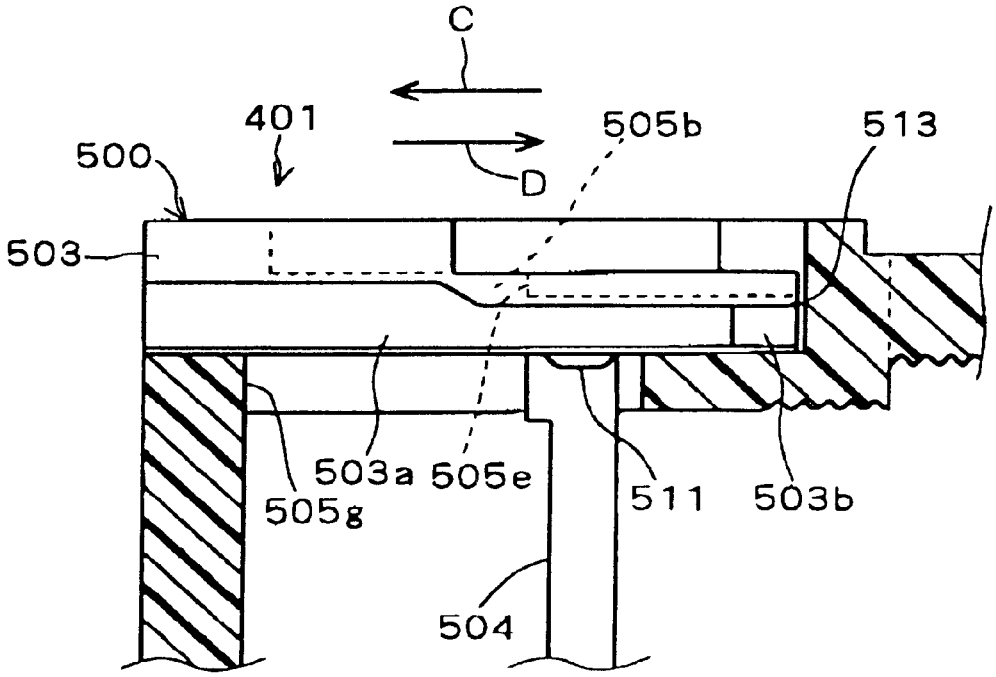
FIG. 30 is a partially enlarged view of FIG. 24.

As shown in FIG. 27, an upper wall portion 505 of the case 30 is provided with a holding concave portion 505*a* for slidably holding the operating portion 503. Right and left side wall portions opposed to each other in the holding concave portion 505*a* are provided with a holding trench 505*b* extended in the slide directions C and D as shown in FIGS. 28 and 29. A flange portion 503*a* provided in right and left side portions of the operating portion 503 is held in the right and left holding trenches 505*b* as shown in FIG. 30. Consequently, the operating portion 503 is slidably held in the case 30 in the slide directions C and D.

A convex portion 503*b* is further protruded from a tip portion of the flange portion 503*a* at an end on the downstream side in the slide direction D in right and left side portions of the operating portion 503. The convex portion 503*b* is held in the holding trench 505*b* so that the operating portion 503 can be prevented more reliably from slipping out of the holding trench 505*b*.

As shown in FIG. 26, moreover, a mark 503*c* is provided on an upper face of the operating portion 503. The mark 503*c* indicates the slide direction C in which the operating portion 503 is to be slid when the common contact 103*a* is forcibly switched from the normally-closed contact 101*a* side to the normally-opened contact 102*a* side.

On the other hand, a step portion 505*e* is provided in a middle portion of an upper wall of upper and lower wall portions 505*c* and 505*d* constituting the right and left holding trenches 505*b* as shown in FIG. 29. Consequently, a width of the holding trench 505*b* is enlarged to be step-shaped toward the downstream side in the slide direction C in the middle portion where the step portion 505*e* is provided. Correspondingly, widths of the right and left flange portions 503*a* of the operating portion 503 are also enlarged to be step-shaped in the middle portion thereof toward the downstream side in the slide direction C.

Furthermore, a bottom wall portion 505*f* of the holding concave portion 505*a* is provided with a through hole 505*g* as shown in FIG. 27. The working bar 504 of the operation lever 500 is inserted into the case 30 through the through hole 505*g* as shown in FIG. 24.

The fulcrum portion 501 is protruded in a position opposed to the contact unit 10 on the side surface at the inner peripheral side of the case 30 as shown in FIG. 24.

Correspondingly, the working bar 504 inserted into the case 30 through the through hole 505*g* passes through the downstream side in the slide direction D of the fulcrum portion 501 and is extended to such a position that a tip portion 504*a* thereof can abut on an end at the downstream side in the slide direction C of the card 104 as shown in FIG. 24. The fulcrum portion 501 is provided in such a position that it can abut on a middle portion 504*b* of the working bar 504.

The lock structure 502 includes a pair of convex portions (engagement portions for locking) 511 provided on both sides of the working bar 504 on the lower surface of the operating portion 503 as shown in FIG. 25, a pair of right and left first concave portions (engagement portions for locking) 512 provided in the bottom wall portion 505*f* of the holding concave portion 505*a* as shown in FIG. 27, a step portion (an engagement portion for locking) 505*e* of the wall portion 505*c* on the upper side constituting the right and left holding trenches 505*b*, and a corner portion (an engagement portion for locking) 513 on the downstream side in the slide direction D at the right and left side ends (the flange portion 503*a*) of the operating portion 503. The convex portion 511 and the first concave portion 512 make a pair such that they can be engaged with each other and the step portion 505*e* and the corner portion 513 make a pair such that they can be engaged with each other.

Moreover, a pair of right and left second concave portions 514 are provided in addition to the first concave portions 512 in the bottom wall portion 505*f* of the holding concave portion 505*a* A situation in which the convex portion 511 and the first concave portion 512 and second concave portion 514 are engaged with each other will be described below.

Figure 31:
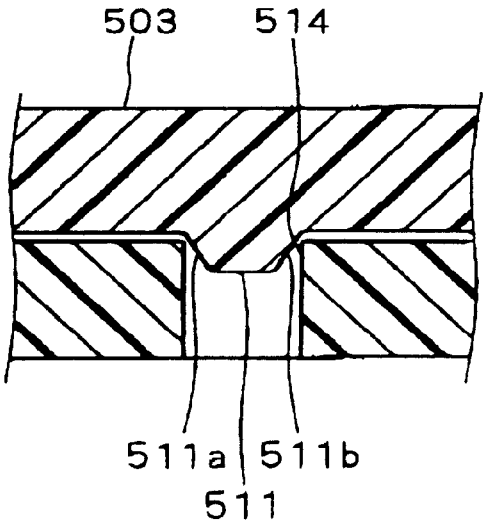
FIG. 31 is a partially enlarged sectional view showing a state illustrated in FIG. 24.

Side surfaces on the downstream and upstream sides in the slide direction C of the convex portion 511 are slant faces such that the concave portions 512 and 514 can easily be disengaged from each other as shown in FIG. 31.

Figure 32:
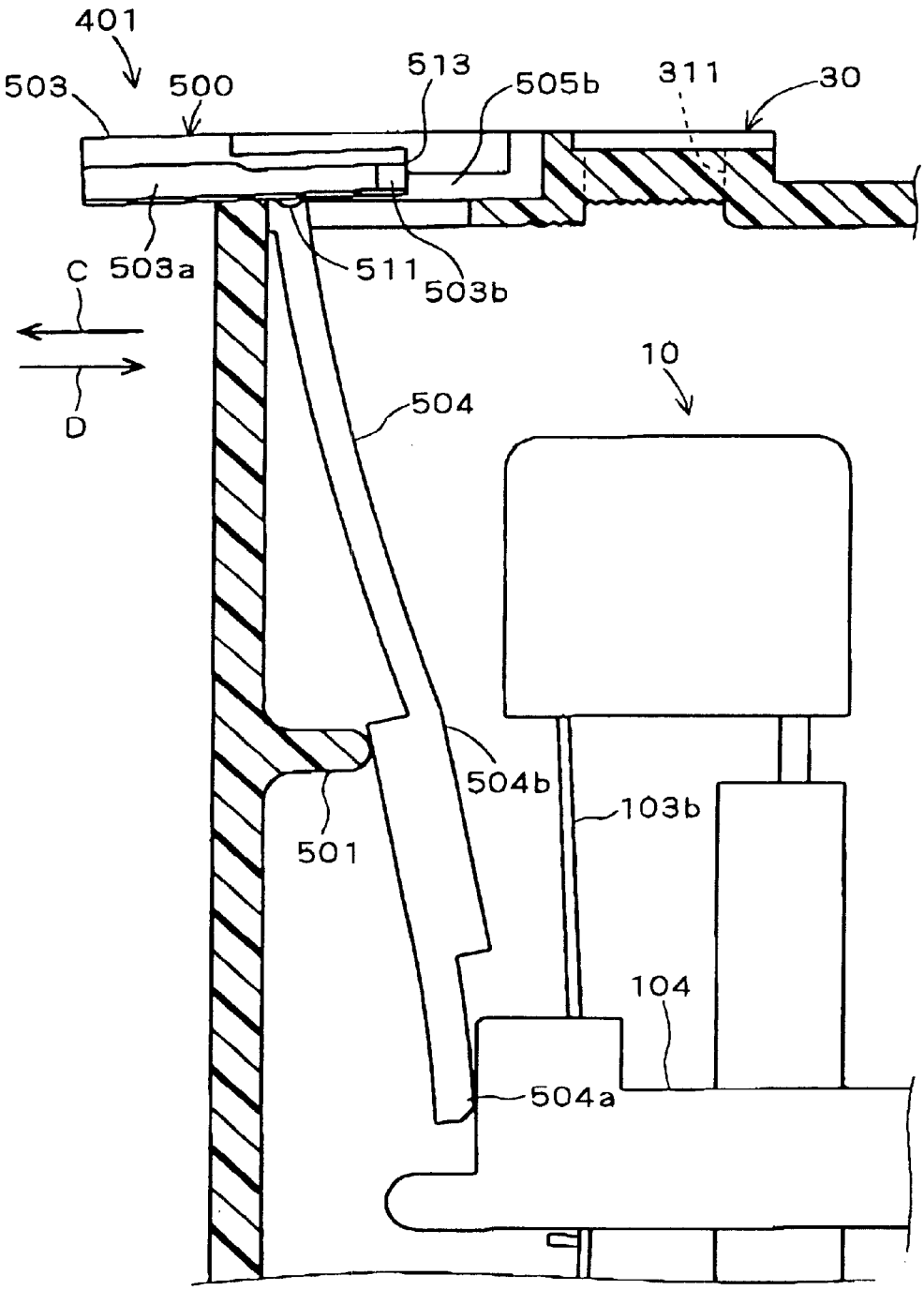
FIG. 32 is an enlarged sectional view showing a main part in a fixed mode according to the variant of FIG. 24.

With such a structure, the operating portion 503 of the operation lever 500 is slid between a neutral position shown in FIG. 24 and a fixed position shown in FIG. 32 in the slide directions C and D by sliding force applied from the outside.

When the operating portion 503 is set in the neutral position, the tip portion 504*a* of the working bar 504 is separated from the card 104 and the card 104 is driven according to the movement of the armature 201 (a neutral mode). At this time, the middle portion 504*b* of the working bar 504 abuts on the fulcrum portion 501.

At this time, moreover, the right and left convex portions 511 are fitted in and engaged with the right and left second concave portions 514 as shown in FIG. 31. Consequently, the operating portion 503 can be prevented from being carelessly moved from the neutral position.

When the sliding force in the slide direction C which has a predetermined strength or more is applied to the operating portion 503, the convex portion 511 is disengaged from the second concave portion 514 so that the operating portion 503 is slid in the slide direction C. At this time, since the movement of the middle portion 504*b* of the working bar 504 in the slide direction C is stopped by the fulcrum portion 501, the working bar 504 is rotated like a seesaw by using the fulcrum portion 501 as a fulcrum so that the tip portion 504*a* of the working bar 504 is moved in an opposite direction to a base end of the working bar 504. Consequently, the tip portion 504 abuts on the card 104 and the card 104 is pressed and moved in a direction opposite to the slide direction C. Consequently, the common contact 103*a* is forcibly switched from the normally-closed contact 101*a* side to the normally-opened contact 102*a* side.

Figure 33:
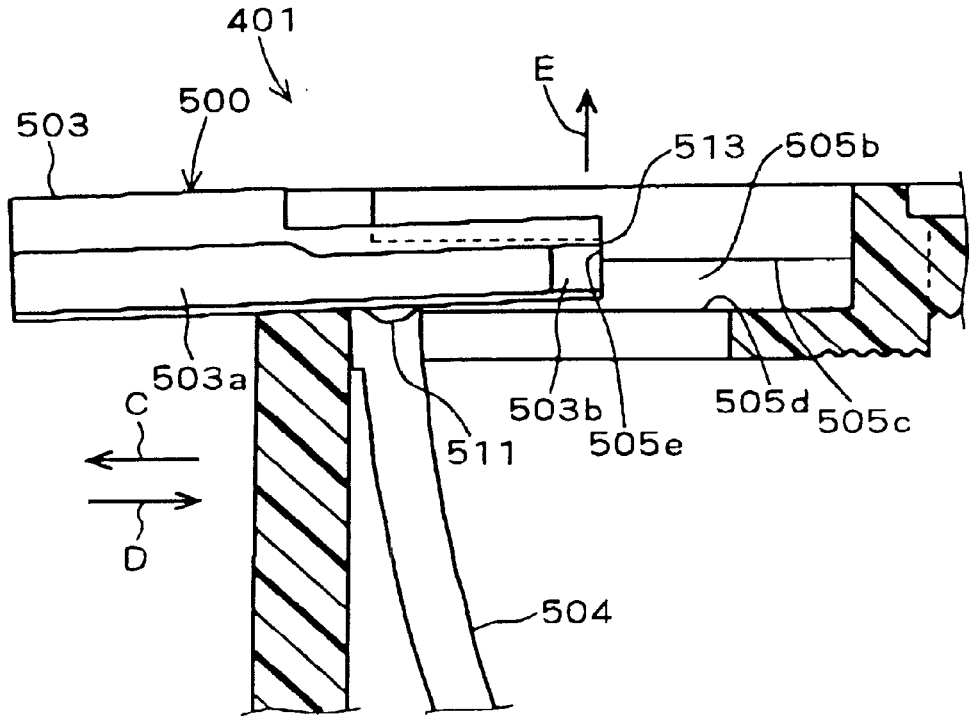
FIG. 33 is a partially enlarged view of FIG. 32.
Figure 34:
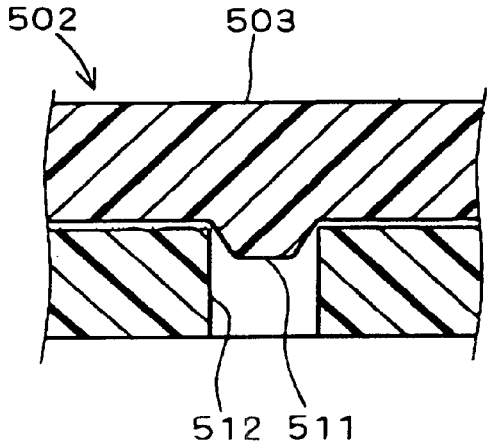
FIG. 34 is a partially enlarged sectional view showing a state illustrated in FIG. 32.

When the operating portion 503 is slid to the fixed position shown in FIG. 32. right and left corner portions 513 of the operating portion 503 are engaged with the step portion 505*e* and the right and left convex portions 511 are fitted in and engaged with the right and left first concave portions 512 as shown in FIGS. 33 and 34. Consequently, the operating portion 503 is stopped to be moved in the slide direction D (locked) and the common contact 103*a* is maintained to be switched to the normally-opened contact 102*a* side (fixed mode).

Description will be given to the principle in which the corner portion 513 is engaged with the step portion 505*e*. More specifically, when the operating portion 503 is moved from the neutral position in the slide direction C and the working bar 504 is thereby rotated by using the fulcrum portion 501 as a fulcrum, force for rotating the operating portion 503 also acts on the operating portion 503 with the rotation of the working bar 504. When the end on the downstream side in the slide direction D of the working portion 503 is pushed up by the force in a direction shown in an arrow E of FIG. 33 so that the operating portion 503 reaches the fixed position, the corner portion 513 is engaged with the step portion 505*e*.

The locking state of the operating portion 503 is released in the following manner. More specifically, the end on the downstream side in the slide direction D of the operating portion 503 is pushed down in a direction opposite to the direction shown in the arrow E, thereby disengaging the corner portion 513 from the step portion 505*e*. With this state maintained, sliding force in the slide direction D which has a predetermined strength or more is applied to the operating portion 503. Consequently, the convex portion 511 is disengaged from the first concave portion 512 so that the operating portion 503 is slid from the fixed position to the neutral position.

As described above, according to the variant, the same effects as those of the contact operating mechanism 401 shown in FIG. 17 and the like can be obtained. In addition, the operation lever 500 of a sliding type can more reduce a length of protrusion of the operating portion 503 from the case 30 when the operating portion 503 is pulled out to the fixed position as compared with the operation lever 402 of a rotating type, and a region occupied by the relay 100 can be reduced.

While the embodiment of the present invention has been described above, the scope of the present invention is not restricted to the embodiment but is defined by the appended claims.

What is claimed is:

1. A relay (100) for opening or closing a contact by an electromagnetic interaction, comprising:

a coil (202) having a core (204) bent like an almost L shape;

an armature (201) provided to generate a predetermined axial rock and displacement by said electromagnetic interaction with said coil (202) and serving to transmit said rock and displacement to a contact portion (10) through a card (104), thereby opening or closing a contact (103*a*);

an engagement portion (201*a*) provided on said armature (201); and energizing means (205*c*), wherein said armature (201) is bent like an almost L shape such that outer peripheral surfaces of both ends thereof can abut on both end faces of said core, said engagement portion (201*a*) is provided by bending at least a part of an edge on one of sides of said armature (201) to be engaged with an edge portion (204*c*) on an end face at one of sides of said core (204), and said energizing means (205*c*) energizes said engagement portion (201*a*) of said armature (201) toward said edge portion (204*c*) of said core (204), thereby holding said armature (201) to be rocked and displaced by setting an engagement part of said engagement portion (201*a*) with said edge portion (204*c*) to be an axis.

2. The relay (100) according to claim 1, wherein said energizing means (205*c*) is constituted by a spring piece provided on a spring member (205) and said spring member (205) serves to restore a displacement of said armature during disappearance of said electromagnetic interaction of said armature (201) with said coil (202), and first and second engagement portions (205*d*, 206*b*) are provided on said spring member (205) and a bobbin (206) of said coil (202) and are engaged with each other to fix said spring member (205) to said bobbin (206).

3. The relay (100) according to claim 2, wherein a holding trench (204*d*) in which a shading coil (211) is to be inserted and held in a press contact state is provided on an end face (204*b*) at the other side of said core (204), and at least a part of a peripheral edge portion of an outer peripheral pole surface (204*f*) positioned on an outer periphery of said shading coil (211) on said end face (204*b*) at the other side of said core (204) divided by said holding trench (204*d*) is chamfered.

4. The relay (100) according to claim 3, wherein an assembly of each part forming a coil portion including said coil (202) and said armature (201) and an assembly of each part forming said contact portion are individually united so that they are constituted separately as a coil unit (20) and a contact unit (10) and can be coupled in a butt state, a through hole (121*a*) penetrating vertically is provided in an extended portion (121) extended from a bottom of said contact unit (10) as a part of said contact unit (10), an inserting portion (206*c*) having an insertion hole (206*d*) for inserting a fixing member which is to be inserted into said through hole (121*a*) is provided on a bottom of said coil unit (20), and a predetermined fixing member (221) is inserted in said insertion hole (206*d*) on a lower surface side of said extended portion (121) in a state in which said inserting portion (206*c*) of said coil unit (20) is inserted in said through hole (121*a*) from above so that said inserting portion (206*c*) can be prevented from slipping out, thereby coupling and fixing said coil unit (20) to said contact unit (10).

5. The relay (100) according to claim 1, further comprising a contact operating mechanism (401) for driving and forcibly opening or closing said contact (103*a*) of said contact portion (10) by dynamic operating force applied from an outside.

6. The relay (100) according to claim 5, wherein said contact operating mechanism (401) includes an operation lever (402) pivotally supported rotatably on a non-movable portion (30) of said relay (100), having both sides of a rotary shaft to act as an operating portion (405) and a working portion (407) respectively, and forced to be opened or closed by causing said working portion (407) to press and move said contact (103*a*) with rotation in a predetermined direction of rotation from a predetermined stop attitude through application of rotating force in said direction of rotation to said operating portion (405).

7. The relay (100) according to claim 6, wherein said contact operating mechanism (401) further includes a lock structure (404) for locking said operation lever (402) into a forced state in which said contact is forced also after said rotating force is released and for releasing said forced state of said operation lever (402) depending on application of reverse rotating force in a direction reverse to said direction of rotation in said forced state.

8. The relay (100) according to claim 5, wherein said contact operating mechanism (401) includes:

an operation lever (500) provided slidably on a non-movable portion (30) of said relay (100); and a fulcrum portion (501) provided in said non-movable portion (30), said operation lever (501) having:

an operating portion (503) provided in said non-movable portion (30) and serving to slide in a slide direction parallel with a direction of movement of said contact (103*a*) upon receipt of sliding force applied from an outside; and a working bar (504) having a predetermined flexibility, protruded from said operating portion (503) in an almost perpendicular direction to said slide direction and extended to such a position that a tip portion thereof can abut on said card (104), wherein said fulcrum portion (501) is provided in such a position that it can abut on a middle portion of said working bar (504), and when said operating portion (503) is slid in said slide direction upon receipt of said sliding force in such a direction that said working bar (504) abuts on said fulcrum portion (501), said middle portion of said working bar (504) abuts on said fulcrum portion (501) and is stopped to be moved so that said tip portion of said working bar (504) is moved in an opposite direction to said operating portion (503) by setting said fulcrum portion (501) to be a fulcrum and presses and moves said contact (103*a*) to forcibly carry out opening or closing.

9. The relay (100) according to claim 8, wherein said contact operating mechanism (401) further includes a lock structure (502) for locking said operating portion (503) of said operation lever (501) into a forced state in which said contact is forced also after said sliding force is released and for releasing said forced state of said operating portion (503) depending on application of reverse sliding force in a direction reverse to said sliding force in said forced state.

10. The relay (100) according to claim 9, wherein said lock structure (502) includes engagement portions for locking (511, 512 ; 513, 505*e*) making at least one pair which are provided in said operating portion (503) and said non-movable portion (30) and are engaged with each other releasably, thereby locking said operating portion (503).

11. A method of manufacturing the relay (100) according to claim 1, wherein a step shape for partially selecting an end on the other side of said armature (201) and an end face on the other side of said core (204) and for causing them to abut thereon is provided on an abutment face of said armature (201), and a relief concave portion (201*e*) constituting said step shape is formed by press molding.

* * * * *